US012635801B2

(12) United States Patent
Endelman et al.

(10) Patent No.: US 12,635,801 B2
(45) Date of Patent: May 26, 2026

(54) CHAIR EXERCISE APPARATUS

(71) Applicant: Balanced Body, Inc., Sacramento, CA (US)

(72) Inventors: Ken Endelman, Sacramento, CA (US); Yunhui Liu, Sacramento, CA (US); Harbir Singh, Roseville, CA (US)

(73) Assignee: Balanced Body, Inc., Sacramento, CA (US)

( * ) Notice: Subject to any disclaimer, the term of this patent is extended or adjusted under 35 U.S.C. 154(b) by 167 days.

(21) Appl. No.: 18/666,946

(22) Filed: May 17, 2024

(65) Prior Publication Data

US 2024/0398125 A1 Dec. 5, 2024

Related U.S. Application Data

(63) Continuation-in-part of application No. 18/327,956, filed on Jun. 2, 2023.

(51) Int. Cl.

| | |
|---|---|
| ***A47C 9/00*** | (2006.01) |
| ***A63B 21/00*** | (2006.01) |
| ***A63B 21/04*** | (2006.01) |
| ***A63B 23/04*** | (2006.01) |

(52) U.S. Cl.

CPC ..... *A47C 9/002* (2013.01); *A63B 21/00061* (2013.01); *A63B 21/00065* (2013.01); *A63B 21/0421* (2013.01); *A63B 21/4047* (2015.10); *A63B 23/04* (2013.01); *A63B 2208/0233* (2013.01)

(58) Field of Classification Search

CPC ..... A63B 1/00–4049; A47C 9/00–005

See application file for complete search history.

(56) References Cited

U.S. PATENT DOCUMENTS

| | | | | |
|---|---|---|---|---|
| 4,570,927 A * | 2/1986 | Petrofsky | ..... | A61H 23/02 601/36 |
| 6,685,602 B2 * | 2/2004 | Colosky, Jr. | ..... | A63B 23/00 482/904 |
| 6,918,857 B2 * | 7/2005 | Chen | ..... | A63B 22/0056 482/53 |
| 6,929,589 B1 * | 8/2005 | Bruggemann | ..... | A63B 21/025 482/904 |

(Continued)

FOREIGN PATENT DOCUMENTS

| | | | | |
|---|---|---|---|---|
| BR | 202022013897 U2 * | 1/2024 | ..... | A61H 1/02 |
| CN | 201150393 Y | 11/2008 | | |

OTHER PUBLICATIONS

International Search Report and Written Opinion of international application No. PCT/US2023/067816, dated Dec. 7, 2023, 14 pages.

*Primary Examiner* — Nyca T Nguyen

(74) *Attorney, Agent, or Firm* — Greenberg Traurig, LLP

(57) ABSTRACT

A Pilates chair exercise apparatus has a frame configured to rest on a horizontal surface, an inverted Y shaped seat support member fastened to an upper portion of the frame, a seat fastened to an upper end of the seat support, and a pair of parallel arms each having a proximal end fastened to the frame and a foot support fastened to a distal end of each of the arms, wherein each arm is biased away from the frame. One foot support carries a retractable member therein configured to engage a portion of a corresponding opposite foot support to selectively lock the foot support and the corresponding opposite foot support together.

9 Claims, 18 Drawing Sheets

(56) References Cited

U.S. PATENT DOCUMENTS 7,794,378 B2 * 9/2010 Splane, Jr. ..... A63B 21/02 482/148
7,833,143 B1 * 11/2010 Tsai ..... A63B 21/4047 482/142
7,998,045 B2 * 8/2011 Splane ..... A63B 21/4047 482/142
8,790,227 B2 * 7/2014 Meister ..... A63B 21/4033 482/141
9,533,190 B2 * 1/2017 Walkama ..... A63B 26/00
9,573,012 B1 * 2/2017 Lee ..... A63B 23/03525
10,646,044 B2 * 5/2020 Jones ..... A47C 7/14
11,318,342 B2 * 5/2022 Hsieh ..... A63B 21/4047
11,547,895 B1 * 1/2023 Wang ..... A63B 21/0421
11,771,231 B1 * 10/2023 Wang ..... A47C 9/002 297/313
2005/0070403 A1 * 3/2005 Yu ..... A63B 21/0083 482/53
2005/0187077 A1 * 8/2005 Daniel ..... A63B 21/4017 482/139
2005/0229985 A1 * 10/2005 Saxenfelt ..... F16K 7/10 138/93
2007/0037677 A1 * 2/2007 Splane ..... A63B 21/4047 482/121
2009/0197746 A1 * 8/2009 Splane, Jr. ..... A63B 22/0056 482/121
2009/0227434 A1 * 9/2009 Baudhuin ..... A63B 22/0056 482/130
2009/0270235 A1 * 10/2009 Solow ..... A63B 21/1609 482/142
2010/0009824 A1 * 1/2010 Splane ..... A63B 21/055 482/130
2010/0069801 A1 * 3/2010 Tsai ..... A63B 21/0552 601/134
2011/0012397 A1 * 1/2011 Wallace ..... A47C 7/029 297/195.11
2011/0152040 A1 * 6/2011 van der Meer .. A63B 21/00076 482/57
2014/0274603 A1 * 9/2014 Howes ..... A63B 23/03525 482/127
2019/0308057 A1 * 10/2019 Chen ..... A63B 21/055
2020/0054920 A1 * 2/2020 Frost ..... A63B 22/0605
2020/0261765 A1 * 8/2020 Jones ..... A63B 22/0005
2020/0298042 A1 * 9/2020 Hsieh ..... A63B 22/0056
2021/0312836 A1 * 10/2021 Case ..... A61B 5/150091

* cited by examiner

CHAIR EXERCISE APPARATUS

CROSS REFERENCE TO RELATED APPLICATIONS

This application is a continuation-in-part of U.S. patent application Ser. No. 18/327,956 filed Jun. 2, 2023, which claims the benefit of priority to U.S. Provisional Application Ser. No. 63/358,939 filed Jul. 7, 2022, the content of which is incorporated herein by reference in its entirety.

BACKGROUND OF THE DISCLOSURE

Field of the Disclosure

The present disclosure relates to an exercise apparatus used in Pilates type exercises. In particular, this disclosure relates to a new Pilates chair that has a number of unique innovations.

State of the Art

Exercise machines utilized in the performance of physical exercises originated by Joseph Pilates typically are often performed on a stationary apparatus called a reformer. Other exercises are conducted on a combo chair that has spring biased foot bar rests or bars on ends of arms which extend out from a pivot bar fixed to a bottom of the chair frame beneath the chair. One or two coil springs extend from beneath a rear of the chair or the chair seat to a point on each of the arms close to the foot rests.

Typically a user presses against the foot bars or rests while either sitting on the chair or standing with both legs or one leg resting on the seat and the other pushing on the foot pad/bar at the ends of the arms. One such chair, called a combo chair, is disclosed in our U.S. Pat. No. 6,919,279. Spring tension is generally limited to the spring rate of typically one or at most two springs attached between the chair frame and each of the arms. One solution has been the anchor configuration set out in our U.S. Pat. No. 6,919,279 which permits a rear end of each of the springs to be attached at three different heights at the rear of the combo chair. This has expanded the versatility of the Combo Chair but still limits the versatility of the combo chair to a relatively limited number of exercises without having to change out the coil springs. Thus there is a need for a more versatile chair that can provide a wider range of tensions between the chair seat and the foot support pads/bars at the ends of the arms that pivot from beneath the chair.

SUMMARY OF THE DISCLOSURE

One exemplary embodiment of a chair exercise apparatus in accordance with the present disclosure has a frame configured to rest on a horizontal surface, a seat support fastened to an upper surface portion of the frame, a seat fastened to the seat support; and a pair of parallel arms each having a proximal end pivotally fastened to one of the frame or a portion of the seat support. Each arm is biased away from the frame toward the seat by a rotary arm torque unit. Each rotary arm torque unit includes a plurality of flat coil springs and each rotary arm torque unit is preferably fastened to the seat support which is rigidly fastened to or part of the frame.

Another embodiment of a chair exercise apparatus in accordance with the present disclosure includes a frame configured to rest on a horizontal surface, preferably an inverted Y shaped seat support merging with or into an upper surface portion of the frame, a seat connected to or fastened to an upper end of the seat support, a pair of parallel rotational arms each having a proximal end fastened to the frame and a foot support fastened to a distal end of each of the arms. Each arm is biased away from the frame toward the seat. Each arm is pivotally biased away from the frame by a rotary arm torque unit mounted beneath the seat.

Preferably each arm torque unit is mounted either to a portion of the frame or to a portion of the inverted Y shaped seat support. In this embodiment, the frame has a generally U shape with two parallel base portions and a mid portion spaced between the parallel base portions. Each rotary arm torque unit includes a plurality of flat coil springs. Each rotary arm torque unit is preferably fastened to the inverted y shaped seat support.

Each rotary arm torque unit preferably comprises a plurality of selectively engageable rotary springs fastened to a common axle rotatably carried by the frame. Each rotary arm torque unit includes a plurality of separately selectable flat coil springs engaging an axle supporting one of the arms. The rotary arm torque unit preferably includes a cassette housing carrying a plurality of flat coil springs in a cassette in the housing and a plurality of selectors for selecting one or more of the flat coil springs to engage the arm to which the rotary arm torque unit is attached. Each selector is configured to engage at least one of the plurality of flat coil springs. The cassette preferably includes a cassette comb having a plurality of spaced tines or partitions. This comb encloses and supports at least one of the plurality of flat coil springs between adjacent tines.

The rotary arm torque unit preferably has a cassette housing carrying a plurality of flat coil springs in a cassette in the housing and a plurality of selectors connected to the cassette housing for selecting one or more of the flat coil springs to engage the arm to which the rotary arm torque unit is attached.

An embodiment in accordance with the present disclosure may alternatively be viewed as a chair exercise apparatus that has a generally U shaped frame configured to rest on a horizontal surface, an inverted Y shaped seat support fastened to an upper surface portion of the U shaped frame, a seat fastened to a seat support portion of the inverted Y shaped seat support, and a pair of parallel arms each having a proximal end pivotally fastened to one of the frame or a diverging portion of the seat support. Each arm is biased away from the frame toward the seat by a rotary arm torque unit fastened below the seat to one of the frame or one of the diverging portions of the seat support. Each arm has a foot rest fastened to a distal end of the arm for a user to press his or her foot against while sitting or standing on the seat of the exercise apparatus.

An embodiment in accordance with the present disclosure may alternatively be viewed as a rotary arm torque unit for use in an exercise apparatus including a housing, a bearing supported rotary shaft in the housing for carrying an arm fastened to one end of the rotary shaft, and a cassette carried on the rotary shaft. This cassette has a plurality of flat coil springs therein each having a first end connected to the rotary shaft and a free second end engageable with the housing via one of a plurality of selectors carried by the housing.

One preferred embodiment of a rotary arm torque unit further includes a cassette comb carried in the housing separating at least two of the plurality of flat coil springs from each other. This cassette comb may be made of metal, a ceramic, or may preferably made of a polymeric material such as plastic. The cassette comb has a plurality of spaced apart tines or partitions to axially space apart at least two of the plurality of flat coil springs along the rotary shaft. One end of each of the flat coil springs is carried in an axial slot in the rotary axle. Preferably the free ends of two of the plurality of flat coil springs engage the housing to provide a preload the rotary arm torque unit. One preferred embodiment of the cassette has 7 flat coil springs.

A kit for installing rotary torque units in a conventional Pilates chair exercise apparatus is also envisioned in this disclosure. A conventional chair exercise apparatus typically has a generally box shaped frame, a seat on the top of the frame and one rotary arm or a pair of rotary arms rotatably fastened to a bottom portion of the frame, and a plurality of elongated coil springs extending from beneath the seat to a distal portion of at least one of the arms to bias the rotary arm or arms upward toward the seat.

A kit for such a chair preferably includes a pair of rotary arm torque units and a left rotary arm and a right rotary arm each having a proximal end and a distal end. Each rotary arm torque unit includes a cassette housing configured to be fastened to the frame beneath the seat of the conventional Pilates chair. A bearing supported rotary shaft in the cassette housing is adapted to be fastened to the proximal end of one of the rotary arms.

The rotary arm torque unit includes a cassette carried on the rotary shaft in a cassette housing. This cassette has a plurality of flat coil springs therein each having a first end connected to the rotary shaft and a free second end engageable with the cassette housing via one of a plurality of selectors carried by the cassette housing. Preferably the rotary arm torque unit includes a cassette comb carried in the cassette housing axially separating one or more of the plurality of flat coil springs from each other. The cassette comb is preferably made of a polymeric material such as plastic. The cassette comb has a plurality of spaced apart tines or partitions to axially space apart one or more of the plurality of flat coil springs along the rotary shaft. The free ends of one or preferably two of the plurality of flat coil springs engage the cassette housing to preload the rotary arm torque unit.

A chair exercise apparatus in accordance with the present disclosure may alternatively be viewed as including a frame configured to rest on a horizontal surface, an inverted Y shaped seat support fastened to an upper surface portion of the frame, a seat fastened to an upper end of the inverted Y shaped seat support, and a pair of parallel arms each having a proximal end fastened to the frame and a foot support fastened to a distal end of each of the parallel arms. Each arm is biased away from the frame toward the seat and one foot support carries a retractable member therein configured to engage a portion of a corresponding opposite foot support to selectively lock the foot support and the corresponding opposite foot support together. Each foot support includes a hollow tube having one end fastened to one of the parallel arms and the retractable member is carried in the one end of the hollow tube in the one foot support so as to be extendable into the hollow tube of the corresponding opposite foot support.

The retractable member may include a push button actuator fastened in the hollow tube and may have a flexible member carried in the hollow tube connecting the push button actuator to the retractable member. This retractable member may include a cylindrical pin sized to extend partially from within the one foot support into a portion of the hollow tube of the corresponding opposite foot support.

An embodiment of a chair exercise apparatus in accordance with the present disclosure may alternatively be viewed as including a frame configured to rest on a horizontal surface, a seat support fastened to an upper portion of the frame, a seat fastened to an upper end of the seat support, and a pair of parallel arms each having a proximal end fastened to the frame and a foot support fastened to a distal end of each of the parallel arms. Each arm is biased away from the frame toward the seat. In this embodiment, one foot support carries a retractable member therein configured to engage a portion of a corresponding opposite foot support to selectively lock the foot support and the corresponding opposite foot support together.

Each foot support includes a hollow tube having one end fastened to one of the parallel arms and the retractable member is carried in the one end of the hollow tube in the one foot support so as to be extendable into the hollow tube of the corresponding opposite foot support.

BRIEF DESCRIPTION OF THE DRAWING

These and other features and advantages of embodiments of the present disclosure will become more apparent from a reading of the following detailed description when taken in conjunction with the drawings.

DETAILED DESCRIPTION

Figure 1:
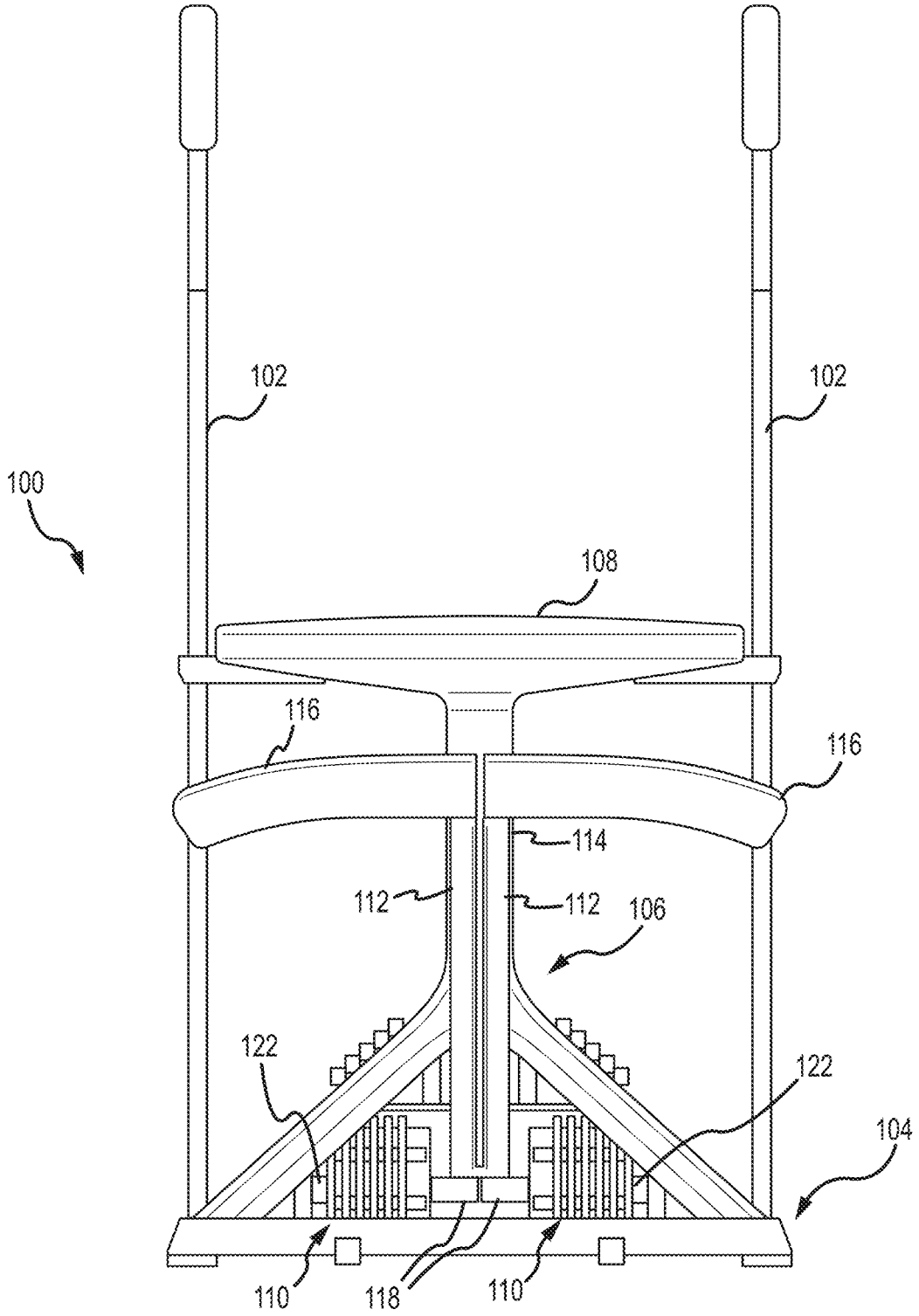
FIG. 1 is a front view of a chair exercise apparatus in accordance with the present disclosure having exemplary hand support posts beside and extending above the seat.
Figure 2:
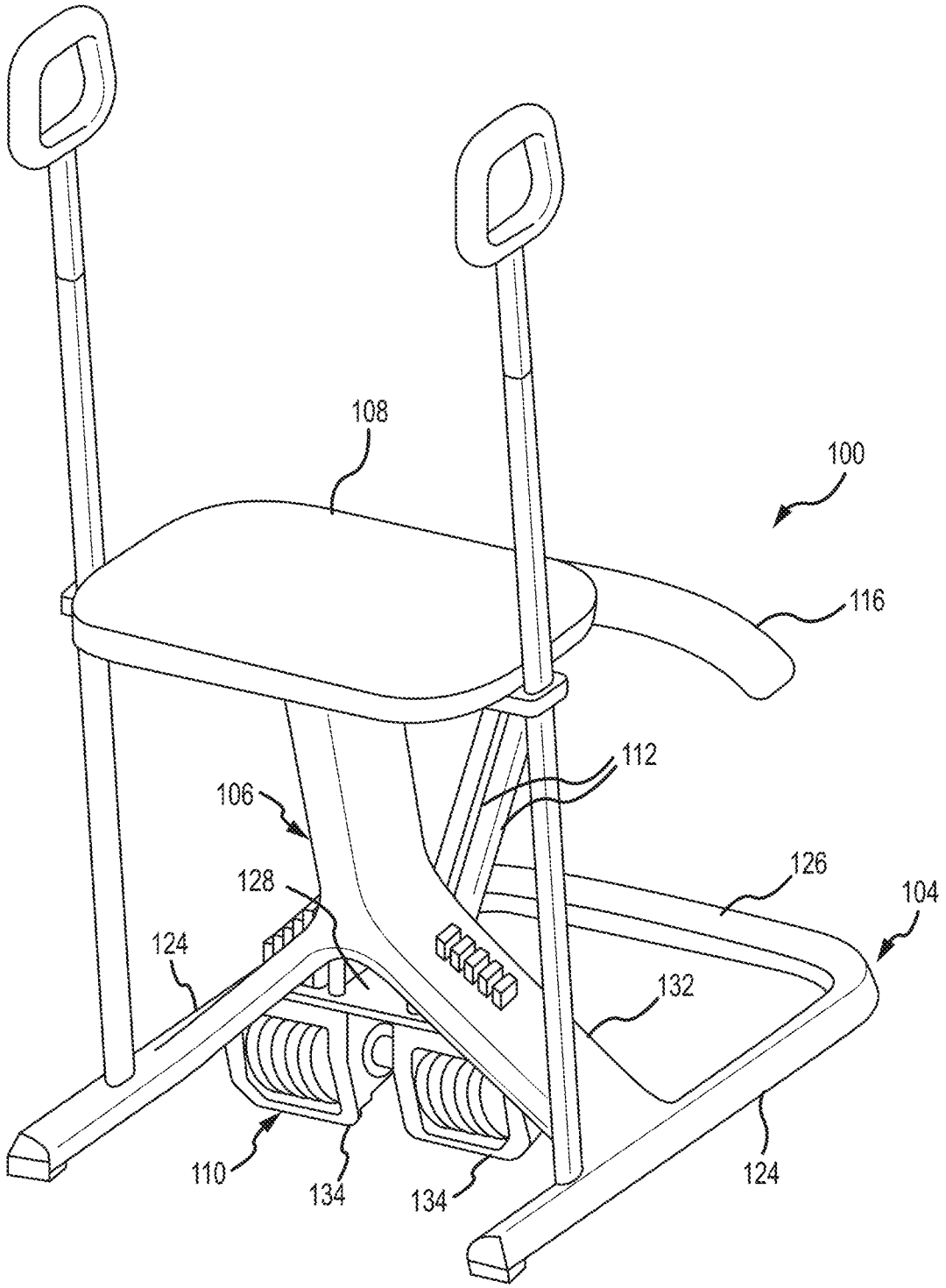
FIG. 2 is a rear perspective view of the chair exercise apparatus shown in FIG. 1.

One exemplary embodiment of a chair exercise apparatus 100 in accordance with the present disclosure is shown in a front view in FIG. 1. A rear perspective view of the chair 100 is shown in FIG. 2. The chair 100 has a generally U shaped bottom frame member 104, an inverted Y seat support member 106 fastened to the U shaped bottom frame member 104, a seat 108 fastened to the seat support member 106, an optional pair of handle support posts 102 removably mounted adjacent the seat 108, a pair of elongated parallel arm members 112 each having a proximal end joined to an axle 118 beneath the Y seat support member 106 and extending outward and upward from beneath the inverted Y seat support member 106 and a spaced pair of rotary arm torque units 110 fastened to the bottom frame member 104 each independently biasing one of the arm members 112 upward toward the seat 108.

A rear perspective view of the chair exercise apparatus 100 is shown in FIG. 2. Each elongated arm 112 has a distal end 114 to which is fastened a foot support or rest 116 and a proximal end 118 rigidly fastened to one end 120 of a torque unit axle 122. The chair exercise apparatus 100 has two arm torque units 110 mounted beneath the seat 108 and connected to the bottom frame member 104 and aligned on a common axis such that a user sitting on the seat 108 can place his or her feet on the side by side foot support rests 116 to perform basic Pilates chair exercises by pressing down on the foot support rests 116 to rotate the arms 112 downward away from the position shown in FIGS. 1 and 2 against spring resistance provided by the arm torque units 110 as further explained below.

Figure 3:
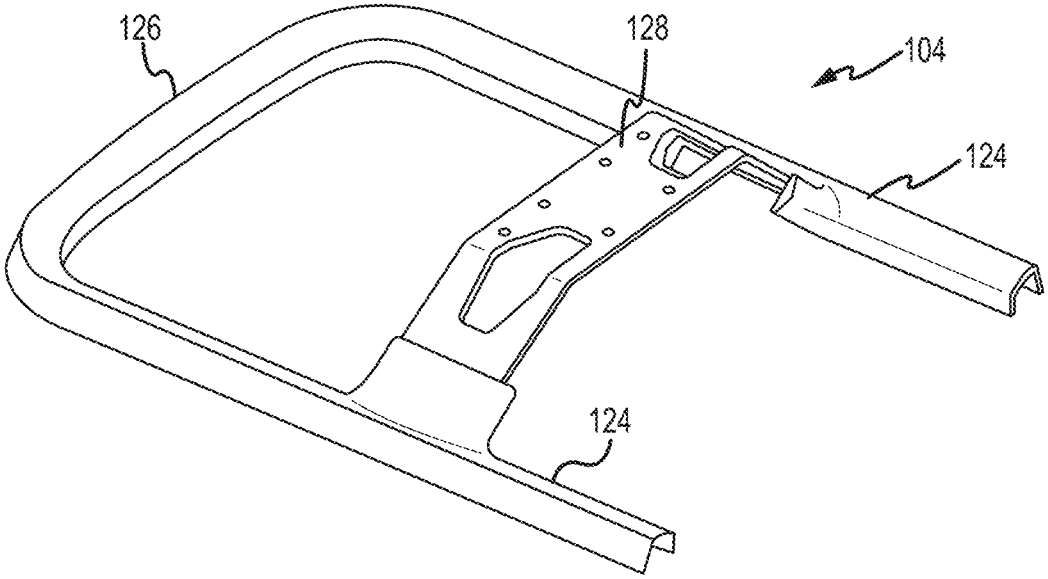
FIG. 3 is a separate rear perspective view of the floor support frame for the exercise apparatus shown in FIGS. 1 and 2.

Floor support for the chair exercise apparatus 100 is provided by the seat 108, the bottom frame member 104 and the inverted Y shaped seat support member 106. A separate rear perspective view of the bottom frame member 104 is shown in FIG. 3. This bottom frame member 104 is a generally U shaped rigid body having spaced parallel leg portions 124 extending parallel from a mid portion 126. The U shaped bottom frame member 104 is designed to rest on a flat support surface such as a floor. Extending between and arched above the leg portions 124 is an arm torque unit support member 128. Together the bottom frame member 104 and arm torque unit support member 128 may be formed as a single sheet metal or cast body, preferably made of steel, aluminum or a high strength polymer material, or may be separate castings or parts suitably fastened together to form a rigid structure.

Figure 4:
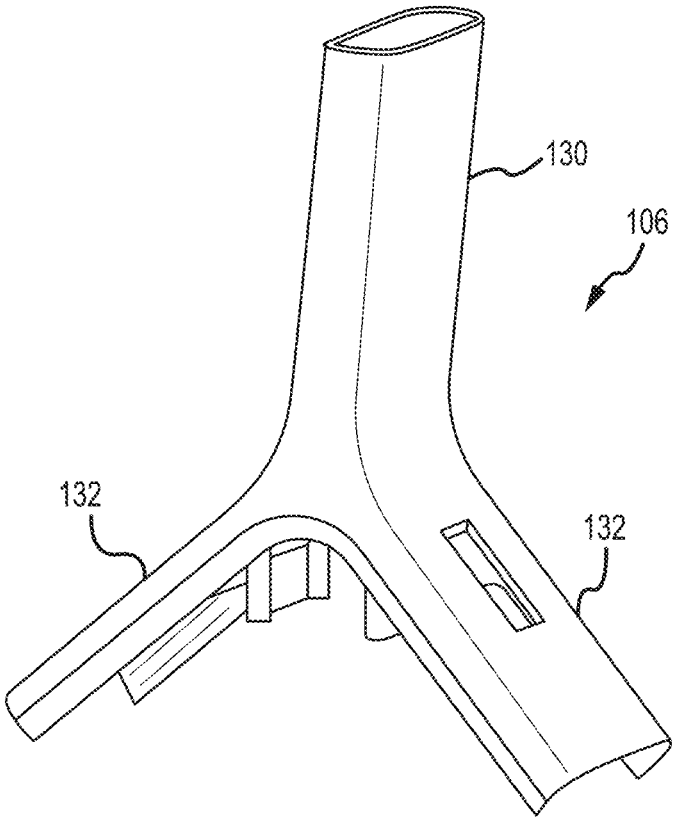
FIG. 4 is separate perspective view of the inverted Y shaped seat post member for the exercise apparatus shown in FIGS. 1 and 2.

FIG. 4 is a separate perspective view of the seat support member 106. Inverted Y shaped support member 106 has a generally tubular seat post portion 130 that has an upper end receiving the seat 108. The lower end of the seat post portion 130 splits into two diverging portions 132. These diverging portions 132 each cover and fasten to the arm torque unit support member 128 of the bottom frame member 104. Each of the Y shaped support member 106 and the bottom frame member 104 could be formed of a suitable steel, aluminum casting, sheet metal or structural polymeric material. The seat 108 may further be covered by any suitable cushioning material such as a covered foam pad.

Each arm torque unit 110 includes a torque axle 122 that has one end 120 rigidly connected to the proximal end 118 of the elongated arm 112. Each torque axle 122 is bearing or bushing supported and carried within a flat rotary spring torque cassette housing or cage 134 that is in turn fastened to the arm torque unit support member 128 which is part of the bottom frame member 104.

Figure 5:
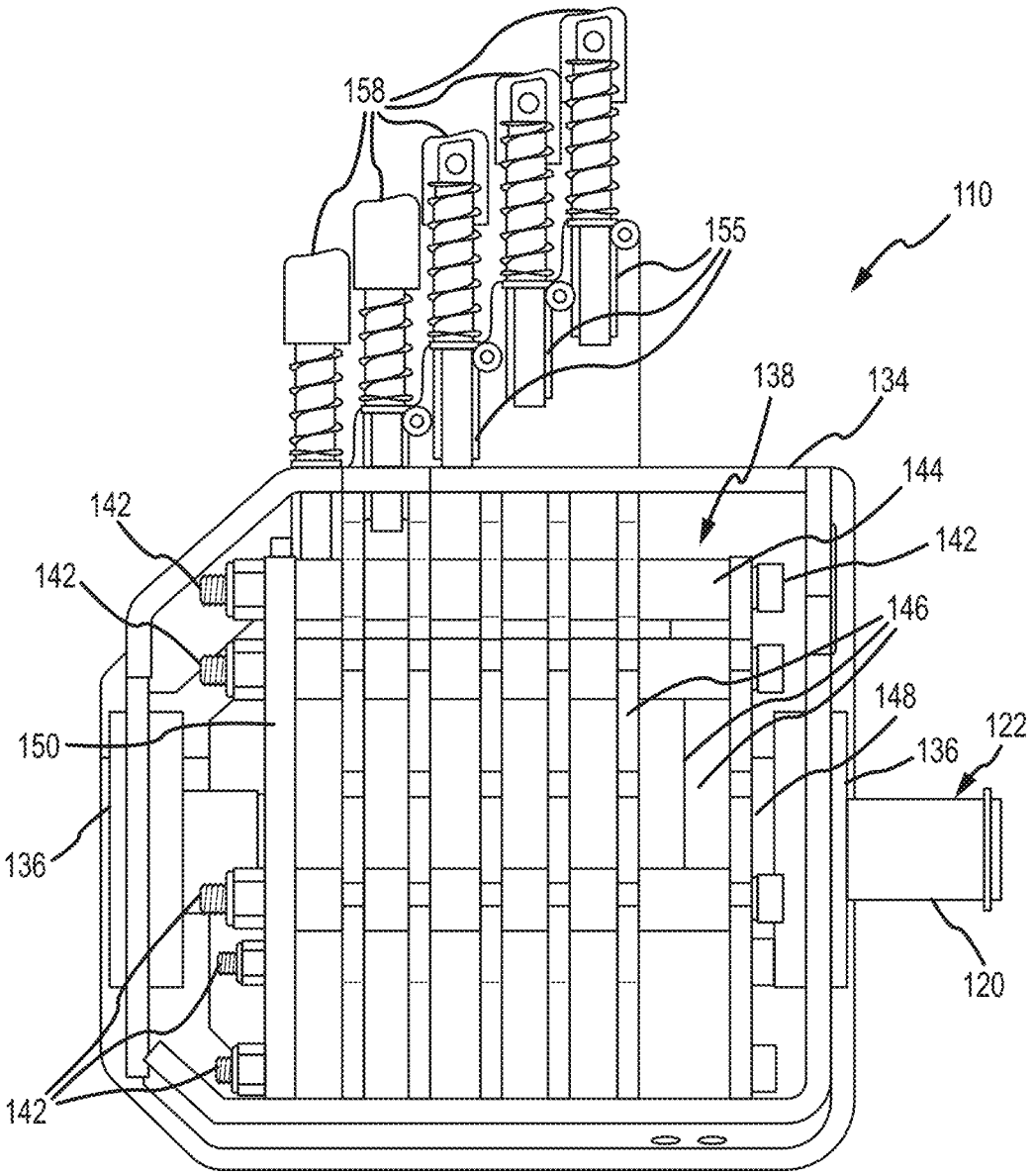
FIG. 5 is a separate front side view of one of the flat coil spring torque units removed from the chair exercise apparatus in accordance with the present disclosure.

A separate side view of one of the arm torque units 110 removed from the apparatus 100 is shown in FIG. 5. The arm torque unit 110 has a somewhat rectangular box cassette cage 134 which supports axle 122 for rotation between two journal bearings or bushings 136. An exemplary cassette 138 including 7 flat coil springs 146 is rotatably supported within the cassette cage 134 shown in FIG. 5. This embodiment is merely exemplary. A different number of flat coil springs 146 could alternatively be provided.

In this exemplary embodiment of the apparatus 100, there are two flat coil springs 146 that are always engaged between the cassette housing or cage 134 and one of the axles 122, as will become more clearly explained below. These two springs 146 provide a baseline tension or torque on each of the elongated arms 112. This baseline torque on each of the elongated arms 112 is needed to maintain the arms 112 biased and raised toward the seat 108 as is shown in FIGS. 1 and 2 when no other flat coil springs 146 are engaged. The remaining 5 flat coil springs 146 in each cassette 138 may be selectively engaged and/or disengaged between the cassette housing 134 and the axle 122 to provide different levels of torque or resistance against rotation of the elongated arms 112.

Figure 8:
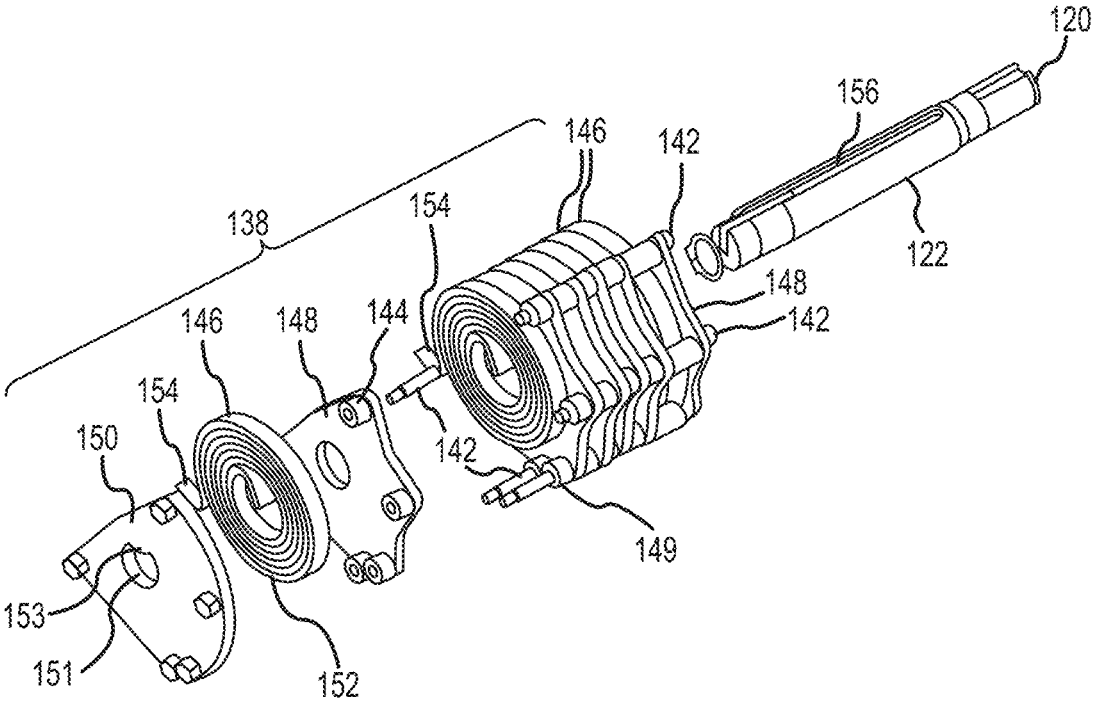
FIG. 8 is a partially exploded perspective view of a coil spring cassette in one of the torque units shown in FIGS. 5-7.

Each cassette 138 is made up of 7 flat coil springs 146 and 6 spring separator plates 148 that are held together in a stack by four cassette bolts 142 and a plurality of spacer tubes 144. A set of 4 spacer tubes 144 is placed on each of the separator plates 148 so as to separate each of the springs 146 on the cassette bolts 142. An end plate 150 completes the assembly of a cassette 138. Referring now to FIG. 8, a partially exploded view of a cassette 138 is shown prior to installation on an axle 122.

Each spring 146, its separator plate 148 and 4 spacers tubes 144 are assembled sequentially onto the four bolts 142 and onto the axle 122. The partially assembled cassette 138 can be assembled onto the axle 122 and finally the end plate 150 is fastened to the threaded ends of the four bolts 142. Note that in FIG. 8, the end plate 150 has a central hole 151 for receiving the distal end of the axle 122. This central hole 151 has a radial tab 153 which engages into the slot 156 in the axle 122 when the end plate 150 is installed on and fastened to the four bolts 142.

Each coil spring 146 has an inner tabbed end 152 and an outer tabbed end 154. The inner tabbed ends 152 slide into an axial slot 156 in the axle 122. The partially assembled cassette 138, minus the end plate 150, can be slid onto the axle 122 with the tabbed inner ends 152 of each spring 146 inside the slot 156 in the axle 122. The end plate 150 can be installed with the proximal end of the axle 122 passing into the hole 151 in the end plate 150. However, the end plate 150 must be rotated a few degrees to permit a tab 153 on the end plate 150 protruding into the hole 151 to enter the slot 156 while aligning the ends of the bolts 142 with the corresponding bolt holes in the end plate 150.

This rotation of the end plate 150 sets a preload on all of the flat coil springs 146 through the axle 122 as shown in FIG. 8. This rotation of the end plate 150 during assembly causes each outer tabbed end 154 of each spring 146 to engage against one of the bolts 142 as is also shown in the schematic view of FIG. 9, setting this preload torque on rotation of the axle 122 when the axle 122 is connected to the proximal end 118 of the arm 112. The assembled cassette 138 may optionally include one or more guide bolt/spacer assemblies 149 which can be used to compensate for non-planar contraction and expansion of the springs 146.

The assembled cassette 138 on an axle 122 is then installed in the cassette cage 134 and the outer bearing or bushing 136 installed in the cage 134 to complete the assembly of the axle 122 into the cage 134 shown in FIG. 5. The distal end 120 of the axle 122 can then be fixed or fastened to the proximal end 118 of the elongated arm 112 through one of the bearings or bushings 136 in the cassette cage 134.

Figure 6:
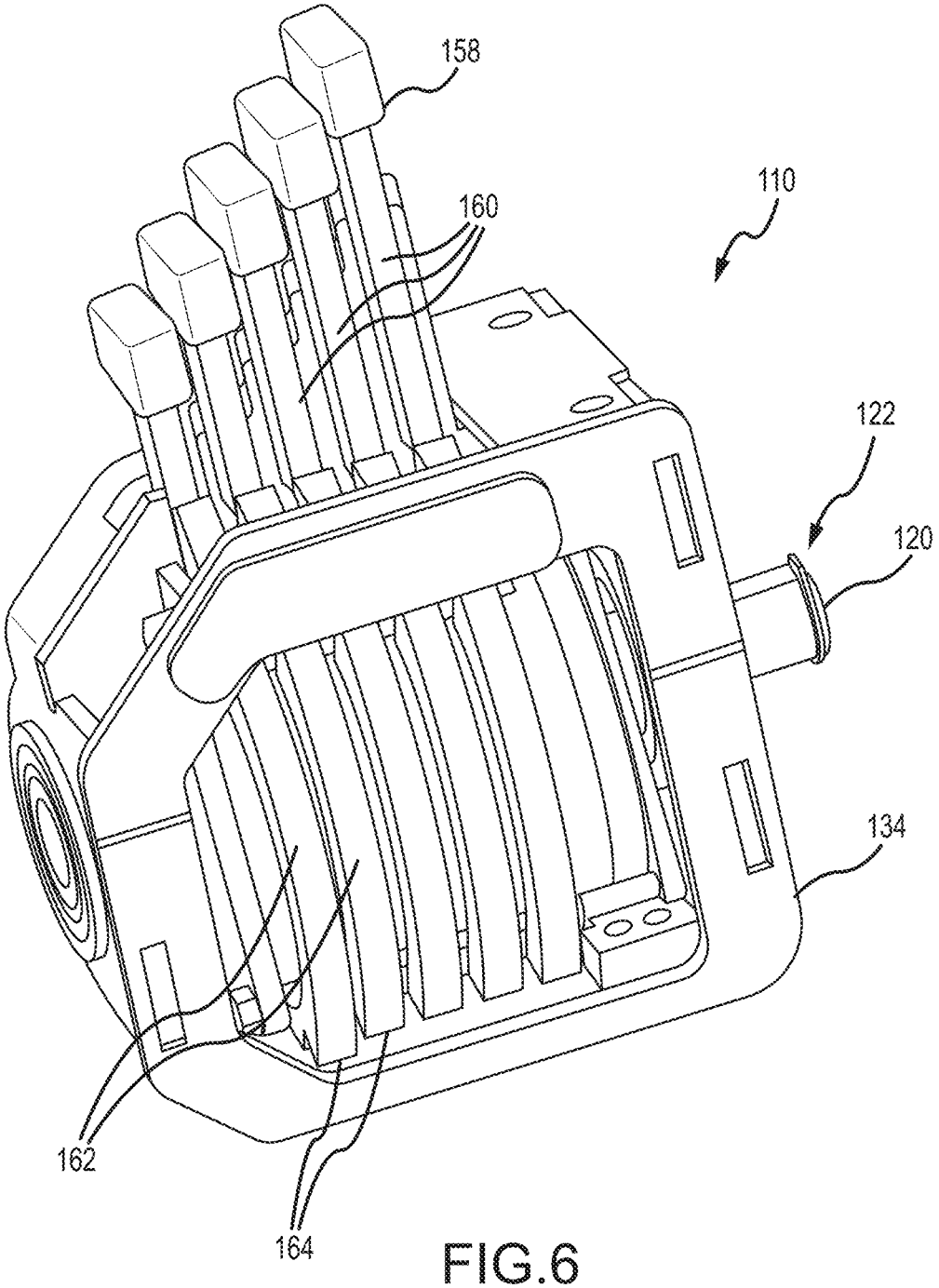
FIG. 6 is a separate rear side perspective view of the other coil spring torque unit of the exercise apparatus similar to that shown in FIG. 5.
Figure 7:
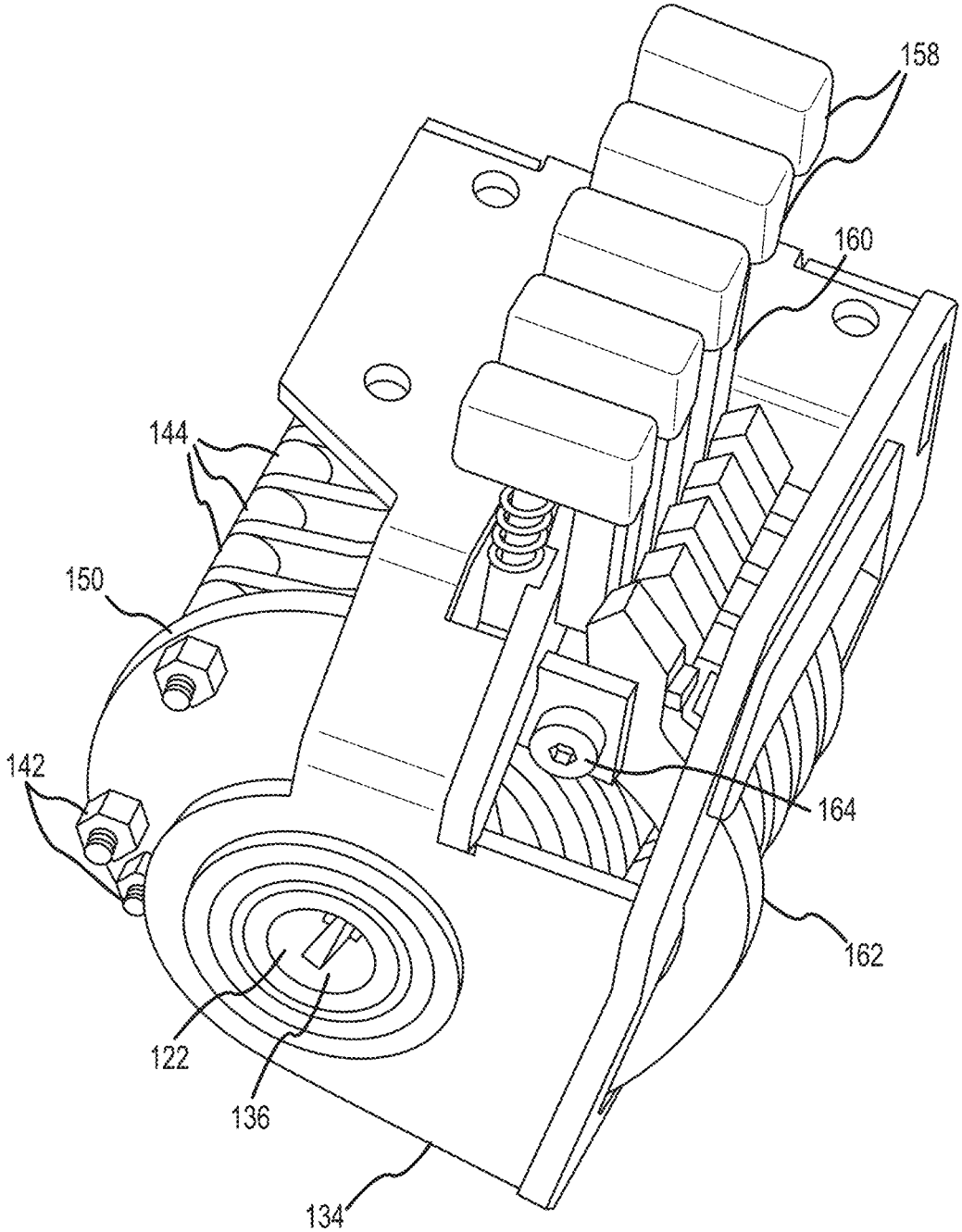
FIG. 7 is a slightly tilted rear perspective view of the torque unit shown in FIG. 6.

Also installed in the cassette housing or cage 134 are five spring loaded selectors 158. Each selector 158 is slidably supported in a channel 155 in the cassette housing or cage 134 and has a selector shaft 160 which extends parallel to the channel 155. This selector shaft 160 is best seen in the opposite perspective view of the torque unit 110 shown in FIG. 6. Each selector shaft 160 is oriented adjacent a pivot finger 162 that pivots about a bolt 164 pinned into the cassette housing or cage 134. Each pivot finger 162 corresponds to one spring 146 in the cassette 138 and has a distal end 166 oriented adjacent one of the outer tabbed ends 154 of a coil spring 146. When no springs 146 are selected, only the two springs 146 nearest the elongated arm 112 are engaged with the arm 112. In this condition, the entire cassette 138 is free to rotate within the cassette housing or cage 134 with the axle 122 as the arm 112 is rotated downward from that shown in FIGS. 1 and 2.

Figure 9:
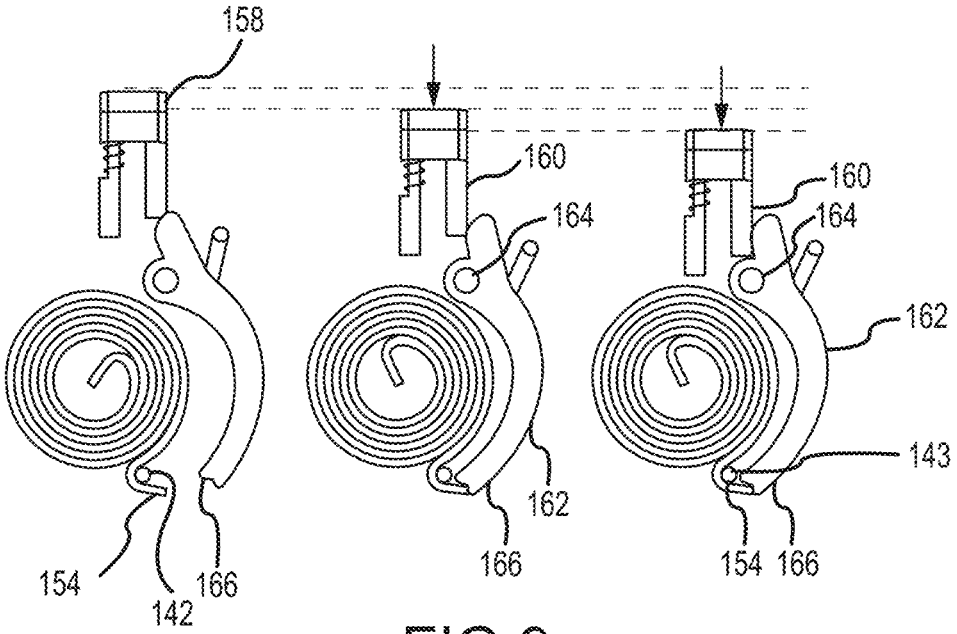
FIG. 9 is a schematic representation of engagement of the coil spring cassette with the torque selector buttons in accordance with the present disclosure.

FIG. 9 shows a schematic representation of operation of the torque selection mechanism in the exemplary embodiment of the chair exercise apparatus 100. In the left most image, the pivot finger 162 is disengaged with the cassette 138 and thus the cassette 138 is free to rotate with the axle 122 as the arm 112 is rotated downward. In the middle image, the selector 158 is depressed which pushes the selector shaft 160 downward, riding downward on an inclined surface of the finger 162 above the pivot bolt 164, which in turn rotates the finger 162 clockwise. The right image shows the selector shaft 160 pushed down past the corner of the inclined surface of the finger 162, fully engaging the distal end 166 of the finger 162 with the tabbed end 154 of a spring 146. Now, when the user steps on the foot rest 116 at the distal end of the arm 112, the outer tabbed end 154 of the flat coil spring 146 is constrained against the distal end 166 of the finger 162 and that particular coil spring 146 must contract during arm 112 rotation. This exerts additional torque on the arm 112, thus increasing the resistance felt by a user depressing the arm 112. When a user depresses the selector 158 again, selector spring tension causes the selector 158 to return or rise to the left image position, disengaging the distal end 166 of the finger 162 from the tabbed outer end of the coil spring 146.

Referring back to FIGS. 5, 6 and FIGS. 1 and 2, the selectors 158 each have different lengths corresponding to positions along the sloped or slanted portion of the diverging portion 132 of the seat support member 106 such that when the torque unit 110 is installed in the frame 104 each selector 158 extends up from the diverging portion 132 by approximately the same amount.

Figure 10:
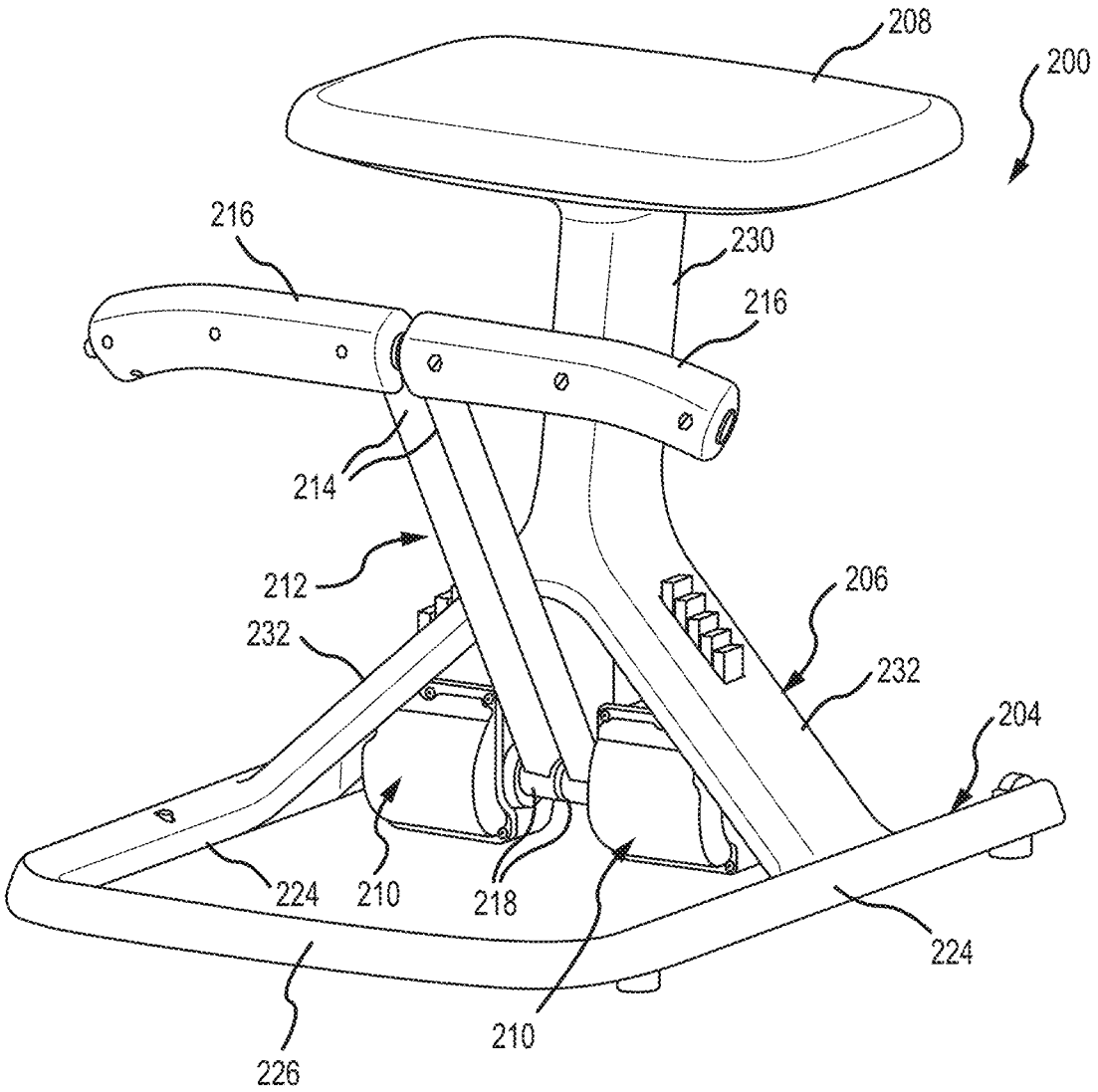
FIG. 10 is a front perspective view of another embodiment of a chair exercise apparatus in accordance with the present disclosure.

Another exemplary embodiment of a chair exercise apparatus 200 in accordance with the present disclosure is shown in a front perspective view in FIG. 10. The chair 200 has a generally U shaped bottom frame member 204, an inverted Y seat support member 206 fastened to the U shaped bottom frame member 204, and a seat 208 fastened to the seat support member 206. An optional pair of handle support posts 102 as in the first embodiment described above may be removably mounted to the apparatus 200 adjacent the seat 208.

The chair exercise apparatus 200 has a pair of elongated parallel arm members 212 each having a proximal end joined to an axle 222 beneath the Y seat support member 206 and extending outward and upward from beneath the inverted Y seat support member 206 and a spaced pair of rotary arm torque units 210 fastened to the bottom frame member 204 via the inverted Y support member 206, each independently biasing one of the arm members 212 upward toward the seat 208.

Each elongated arm 212 has a distal end 214 to which is fastened a foot support pedal or rest 216 and a proximal end 218 rigidly fastened to one end of a torque unit axle 222. The chair exercise apparatus 200 has two arm torque units 210 mounted beneath the seat 208 and connected to the bottom frame member 204 via divergent portions 232 of the inverted Y seat support member 206 and aligned on a common axis such that a user sitting on the seat 206 can place his or her feet on the side by side foot support rests 216 to perform basic Pilates chair exercises by pressing down on the foot support rests 216 to rotate the arms 212 downward away from the position shown in FIG. 10 against spring resistance provided by the arm torque units 210. Each of the foot support pedals or rests 216 preferably extends laterally from the arm 212 to which it is attached and may be straight, bent or curved as is shown in FIG. 10. This curved or bent shape provides a unique gripping surface and shape for a user to grasp in certain exercises wherein the user grasps the rest 216 with his/her hand rather than a foot.

Floor support for the chair exercise apparatus 200 is provided by the seat 208, the bottom frame member 204 and the inverted Y shaped seat support member 206. This bottom frame member 204 is preferably a generally U shaped rigid body having spaced parallel leg portions 224 extending from a mid portion 226 of the frame member 204. The U shaped bottom frame member 204 is designed to rest on a flat support surface such as a floor.

Inverted Y shaped support member 206 has a generally tubular seat post portion 230 that has an upper end receiving the seat 208. The lower end of the seat post portion 230 splits into two diverging portions 232. These diverging portions 232 each cover and fasten to a rotary arm torque unit 210 and rigidly join or are fastened to the bottom frame member 204. As in the first embodiment 100, the Y shaped support member 206 and the bottom frame member 204 could be formed of a suitable steel, aluminum casting, sheet metal or structural polymeric material. The seat 208 may further be covered by any suitable cushioning material such as a covered foam pad.

Figure 11:
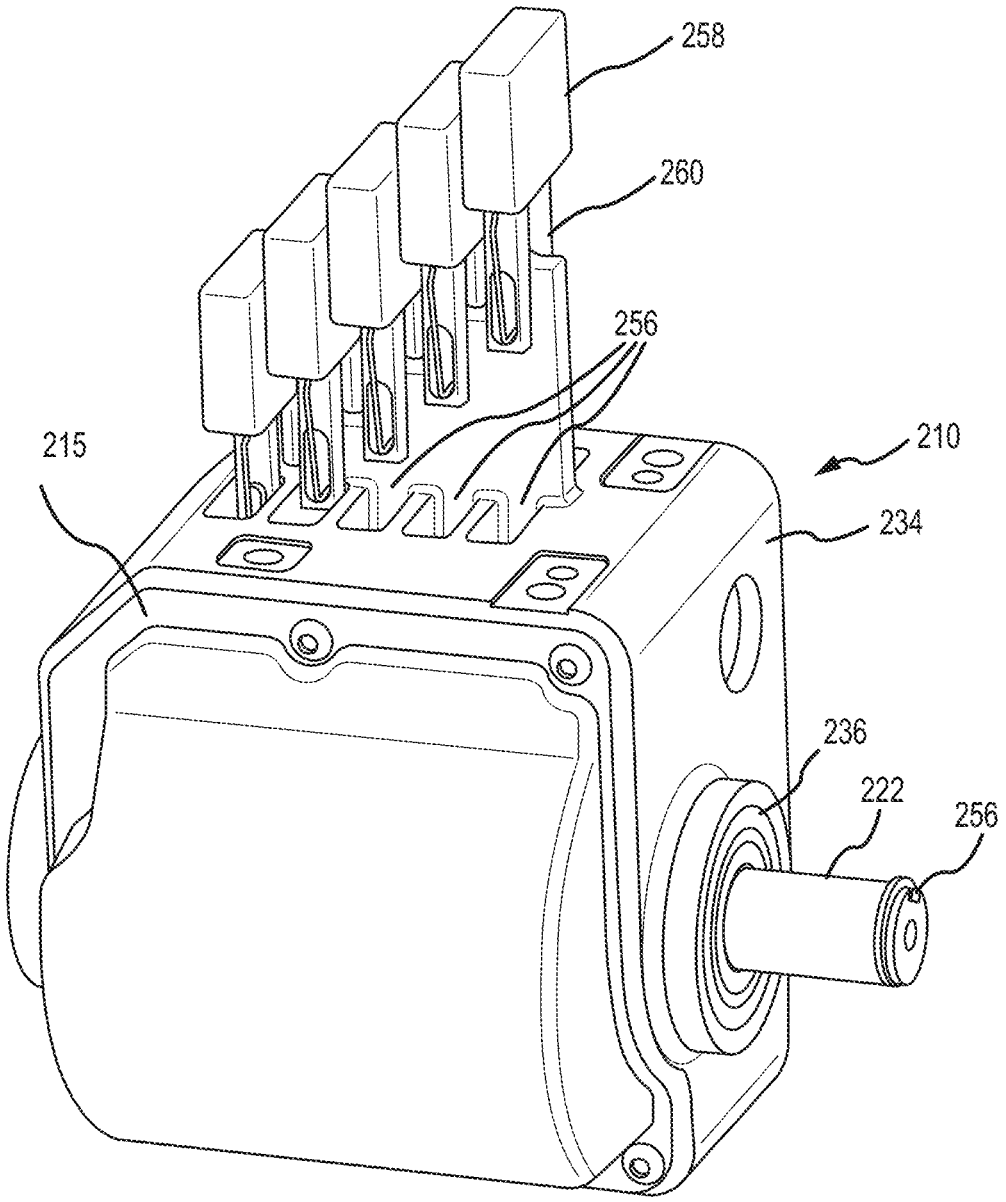
FIG. 11 is a perspective view of one of the torque modules removed from the chair exercise apparatus shown in FIG. 10.

Each arm torque unit 210 includes a torque axle 222 that has one end rigidly connected to the proximal end 218 of one of the elongated arms 212. A separate perspective view of one of the arm torque units 210 is shown in FIG. 11. The front and rear sides of the torque unit 210 has fastened to it a plastic or metal cover 215 which keeps dirt and dust out of the inner workings of the rotary arm torque unit 210. In the FIGS. 12-14 that follow, these covers 215 are removed for clarity in explanation.

Each torque axle 222 is bearing or bushing supported and carried within a flat rotary spring torque cassette housing or cage 234 that is in turn preferably rigidly fastened to the bottom frame member 204 via a portion of one of the diverging portions 232 of the inverted Y shaped support member 206. The arm torque units 210 are essentially the same as those described above with reference to the exercise chair 100 except for the structure of the cassette 238.

Figure 12:
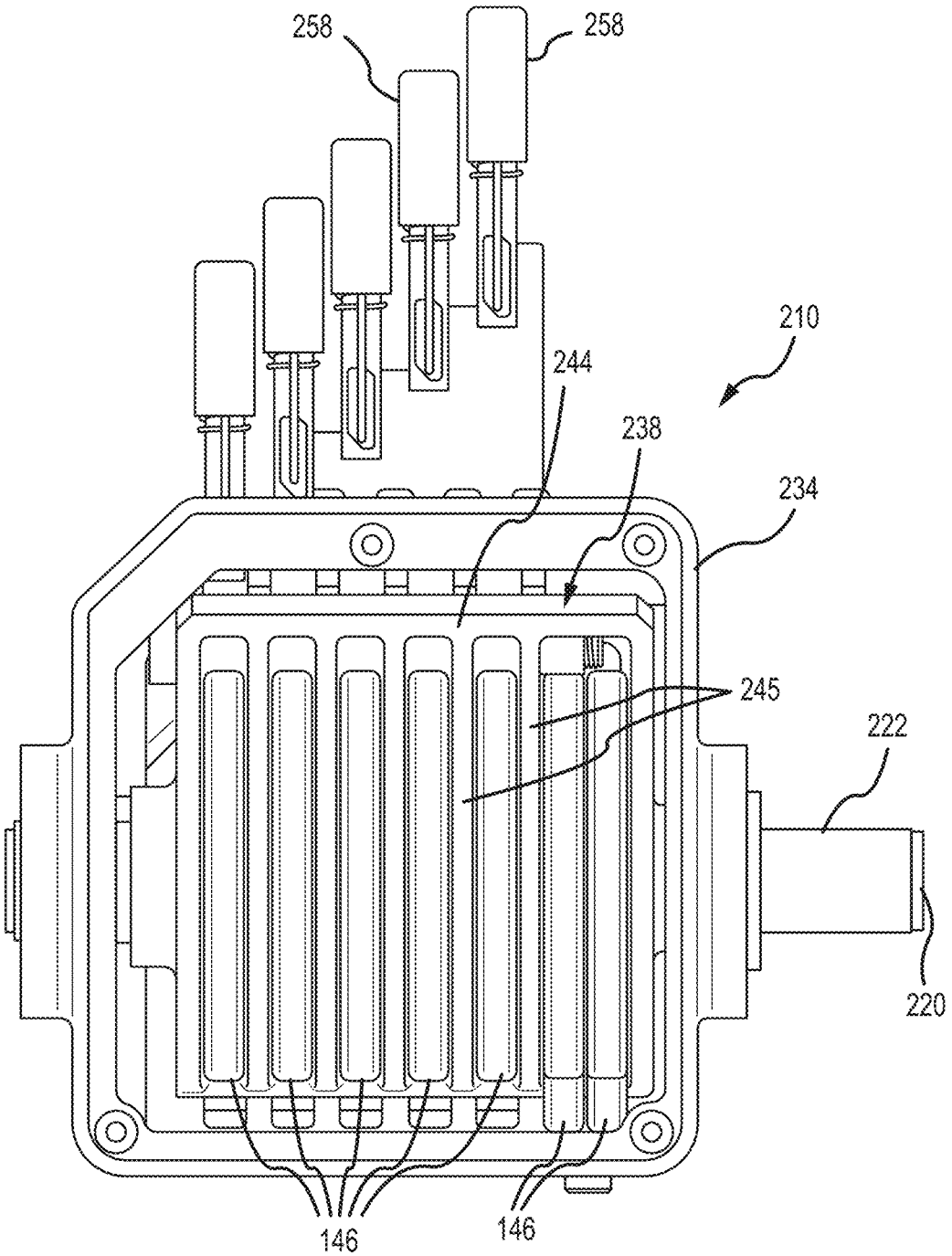
FIG. 12 is a side view of the torque module shown in FIG. 11 with its side covers removed.
Figure 13:
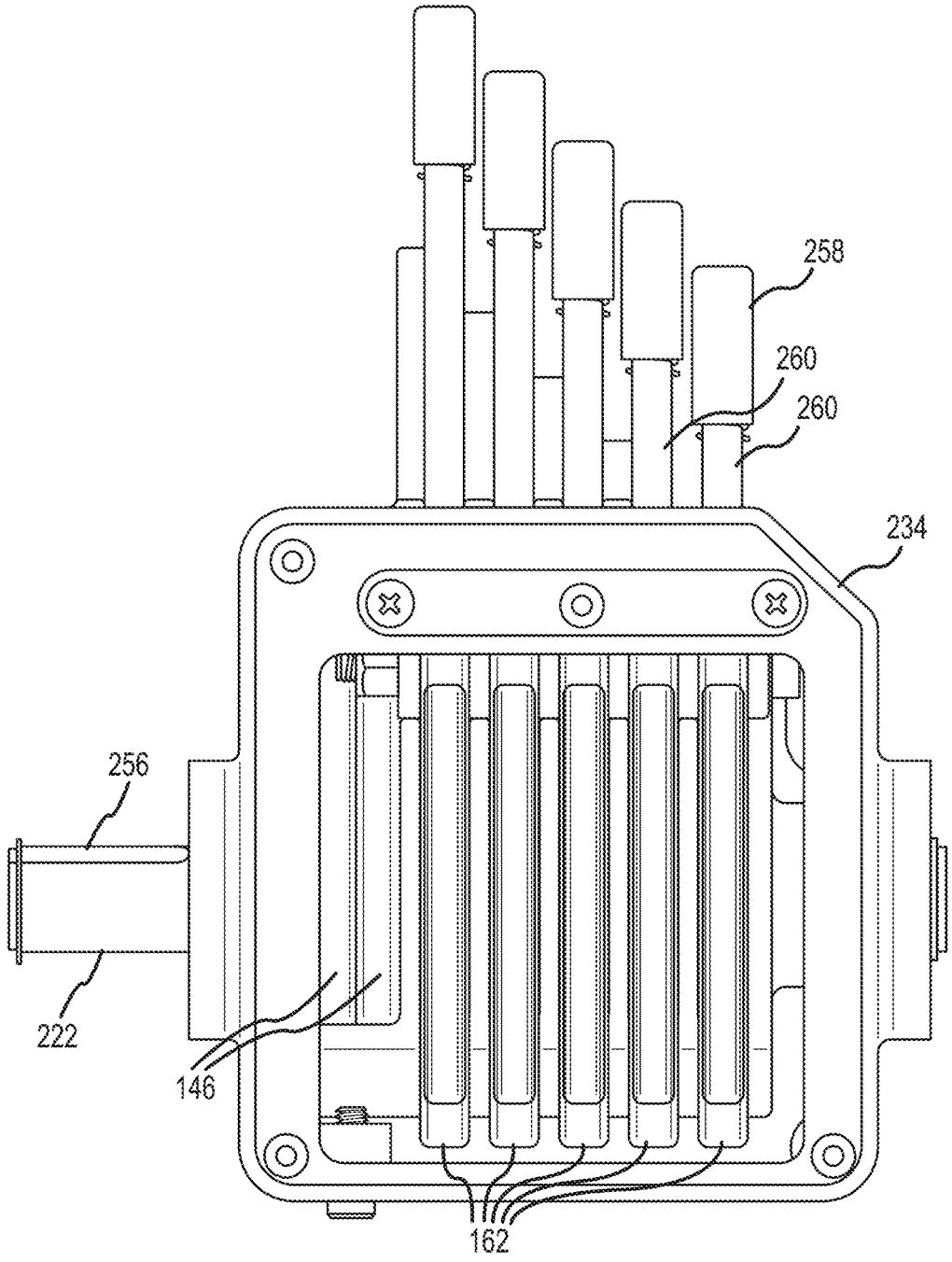
FIG. 13 is an opposite side view of the torque module shown in FIG. 12.
Figure 14:
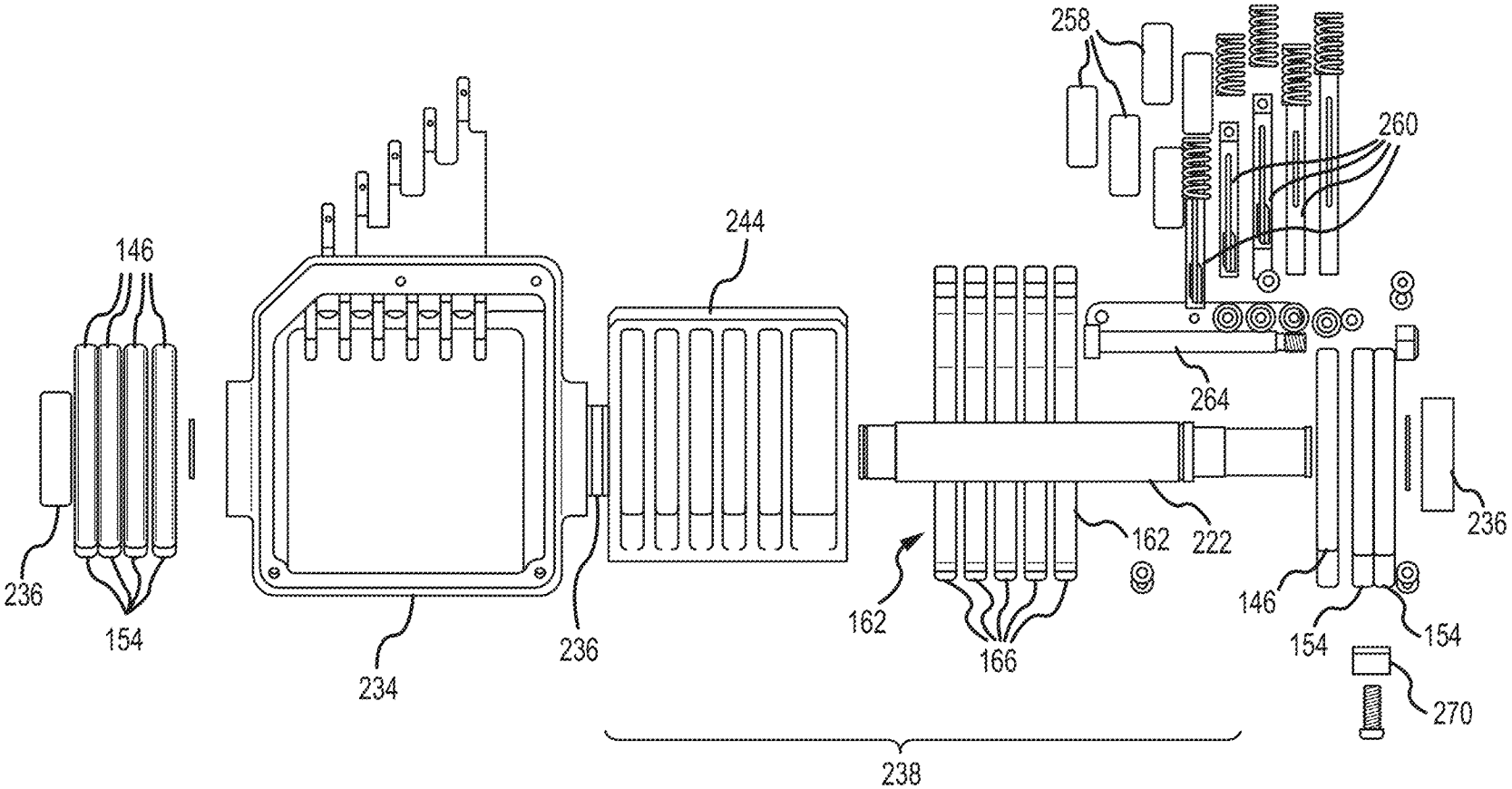
FIG. 14 is an exploded view of the torque module shown in FIG. 12.

A separate side view of one of the arm torque units 210 removed from the chair exercise apparatus 200 is shown in FIG. 12. An opposite side view of the arm torque unit 210 is shown in FIG. 13. Finally, an exploded view of the arm torque unit 210 is shown in FIG. 14 so that the internal components can be easily identified in the discussion that follows.

The arm torque unit 210 has a somewhat rectangular box shaped cassette cage or housing 234 which supports axle 222 for rotation between two journal bearings or bushings 236. An exemplary cassette 238 including a stack of 7 flat clock coil springs 146 is rotatably supported within the cassette housing 234 as shown in FIGS. 12 and 13. This embodiment 200 is merely exemplary. A different number of flat coil springs 146 could alternatively be provided.

In this exemplary embodiment of the chair exercise apparatus 200, two flat coil springs 146 are always engaged between the cassette housing or cage 234 and the axle 222, as will become more clearly explained below. These two springs 146 provide a baseline tension or torque on each of the elongated arms 212. This baseline torque on each of the elongated arms 212 is needed to maintain the arms 212 biased and raised toward the seat 208 as is shown in FIG. 10 when no other flat coil springs 146 are engaged. The remaining 5 flat coil springs 146 in each cassette 238 may be selectively engaged and/or disengaged between the cassette housing 234 and the axle 222 to provide different levels of torque or resistance against rotation of the elongated arms 212.

Each cassette 238 is made up of two flat coil springs 146, and five coil springs 146 that are held together and carried in an axial stack within a cassette comb 244. This cassette comb 244 has a plurality of spaced apart tines or partitions 245. Each partition separates one of the springs 146 from an adjacent spring 146, except for the pair of preload springs 146, which are carried together in the cassette 238. This cassette comb 244 may be a 3D printed metal or nonmetal comb structure. It may alternatively be a rigid polymeric or plastic molded part. This cassette comb 244 takes the place of the separator plates 148, bolts 142, end plate 150 and plurality of spacer tubes 144 in the first embodiment 110. This cassette comb 244 separates each of the five springs 146 and the pair of preload springs 146 as in the first embodiment 110.

Each coil spring 146 has an inner tabbed end 152 and an outer tabbed end 154. The inner tabbed ends 152 slide into an axial slot 256 in the axle 222. The partially assembled cassette 238 can be slid onto the axle 222 with the tabbed inner ends 252 of each spring 146 inside the slot 256 in the axle 222. Assembly of the cassette 238 into the cassette housing 234 is basically the same as described above with reference to FIGS. 5 and 9.

During assembly, the axle rotation with respect to the cassette comb 244 imparts a desired preload on all springs 146. Then a key 270 (shown in FIG. 14) is inserted to lock the axle 222 together with the cassette comb 244. The assembled cassette 238 on an axle 222 is then installed in the cassette cage or housing 234 and the outer bearing or bushing 236 is installed in the cassette cage or housing 234 to complete the assembly of the axle 222 into the cassette cage or housing 234 as is shown in FIG. 12.

Also installed in the cassette housing or cage 234 are five spring loaded selectors 258, like in the first embodiment 110. Each selector 258 is slidably supported in a channel 255 in the cassette housing or cage 234 and has a selector shaft 260 which extends parallel to the channel 255. This selector shaft 260 is best seen in the exploded view of the arm torque unit 210 shown in FIG. 14. Each selector shaft 260 is oriented adjacent a pivot finger 162 that pivots about a bolt 264 pinned into the cassette housing or cage 234. Each pivot finger 162 corresponds to one spring 146 in the cassette 238 and has a distal end 166 oriented adjacent one of the outer tabbed ends 154 of a coil spring 146. When no springs 146 are selected, only the two springs 146 nearest the elongated arm 212 are engaged with the arm 212. In this condition, the entire cassette 238 is free to rotate within the cassette housing or cage 234 with the axle 222 as the arm 212 is rotated downward from that shown in FIG. 10.

FIG. 9 shows a schematic representation of operation of the torque selection mechanism in the two exemplary embodiments of the chair exercise apparatus 100 and 200. In the left most image, the pivot finger 162 is disengaged with the cassette 138 (or 238) and thus the cassette 138 (or 238) is free to rotate with the axle 122 (or 222) as the arm 112 (or 212) is rotated downward. In the middle image, the selector 158 (or 258) is depressed which pushes the selector shaft 160 (or 260) downward, riding downward on an inclined surface of the finger 162 above the pivot bolt 164, which in turn rotates the finger 162 clockwise. The right image shows the selector shaft 160 pushed down past the corner of the inclined surface of the finger 162, fully engaging the distal end 166 of the finger 162 with the tabbed end 154 of a spring 146. Now, when the user steps on the foot rest 116 (or 216) at the distal end of the arm 112 (or 212), the outer tabbed end 154 of the flat coil spring 146 is constrained against the distal end 166 of the finger 162 and that particular coil spring 146 must contract during arm 112 or 212 rotation. This exerts additional torque on the arm 112 or 212, thus increasing the resistance felt by a user depressing the arm 112 or 212. When a user depresses the selector 158 again, selector spring tension causes the selector 158 to return or rise to the left image position, disengaging the distal end 166 of the finger 162 from the tabbed outer end of the coil spring 146.

Referring back to FIGS. 5, 6 and FIGS. 1 and 2, the selectors 158 (or 258) each have different lengths corresponding to positions along the sloped or slanted portion of the diverging portion 132 (or 232) of the seat support member 106 (or 206) such that when the torque unit 110 (or 210) is installed in the frame 104 (or 204) each selector 158 extends up from the diverging portion 132 (or 232) by approximately the same amount.

A kit for installing one or more rotary arm torque units 210 in a conventional Pilates chair exercise apparatus is also envisioned in this disclosure. A conventional chair exercise apparatus typically has a generally box shaped frame, a seat on the top of the frame and one or a pair of rotary arms rotatably fastened to a bottom portion of the frame, each having a foot pad or bar fastened to its distal end, and a plurality of elongated coil springs extending from beneath the seat to at least one of the arms to bias the rotary arm or arms upward toward the seat.

A kit for such a chair in accordance with the present disclosure includes a pair of rotary arm torque units 210 and a left rotary arm such as arm 212 and a right rotary arm such as arm 212 each having a proximal end 218 and a distal end 214 and may include a foot bar 216. Each rotary arm torque unit 210 in the kit includes a cassette housing 234 configured to be fastened to the frame beneath the seat of the Pilates chair. It is to be understood that this housing 234 would most likely have a different external box shape than that shown so as to match with the contours of the conventional Pilates chair exercise apparatus to which it is being installed.

A bearing supported rotary shaft such as shaft 222 in the cassette housing 234 is adapted to be fastened to the proximal end 218 of one of the rotary arms 212. The rotary arm torque unit 210 includes a cassette 238 carried on the rotary shaft 222. This cassette 238 has a plurality of flat coil springs 146 therein each having a first end connected to the rotary shaft 222 and a free second end engageable with the cassette housing 234 via one of a plurality of selectors such as selectors 258 carried by the cassette housing 234 (although each likely having a different shape than that shown in this disclosure).

Preferably the rotary arm torque unit 210 in such a kit includes a cassette comb 244 carried in the cassette housing 234 axially separating each one or two of the plurality of flat coil springs 146 from each other. The cassette comb 244 is preferably made of a polymeric material such as plastic. The cassette comb 244 has a plurality of spaced apart tines or partitions 246 to axially space apart at least two of the plurality of flat coil springs 146 along the rotary shaft 222. The free ends of one or preferably two of the plurality of flat coil springs 146 in the rotary arm torque unit 210 engage the cassette housing 234 to preload the rotary arm torque unit 210.

Figure 15:
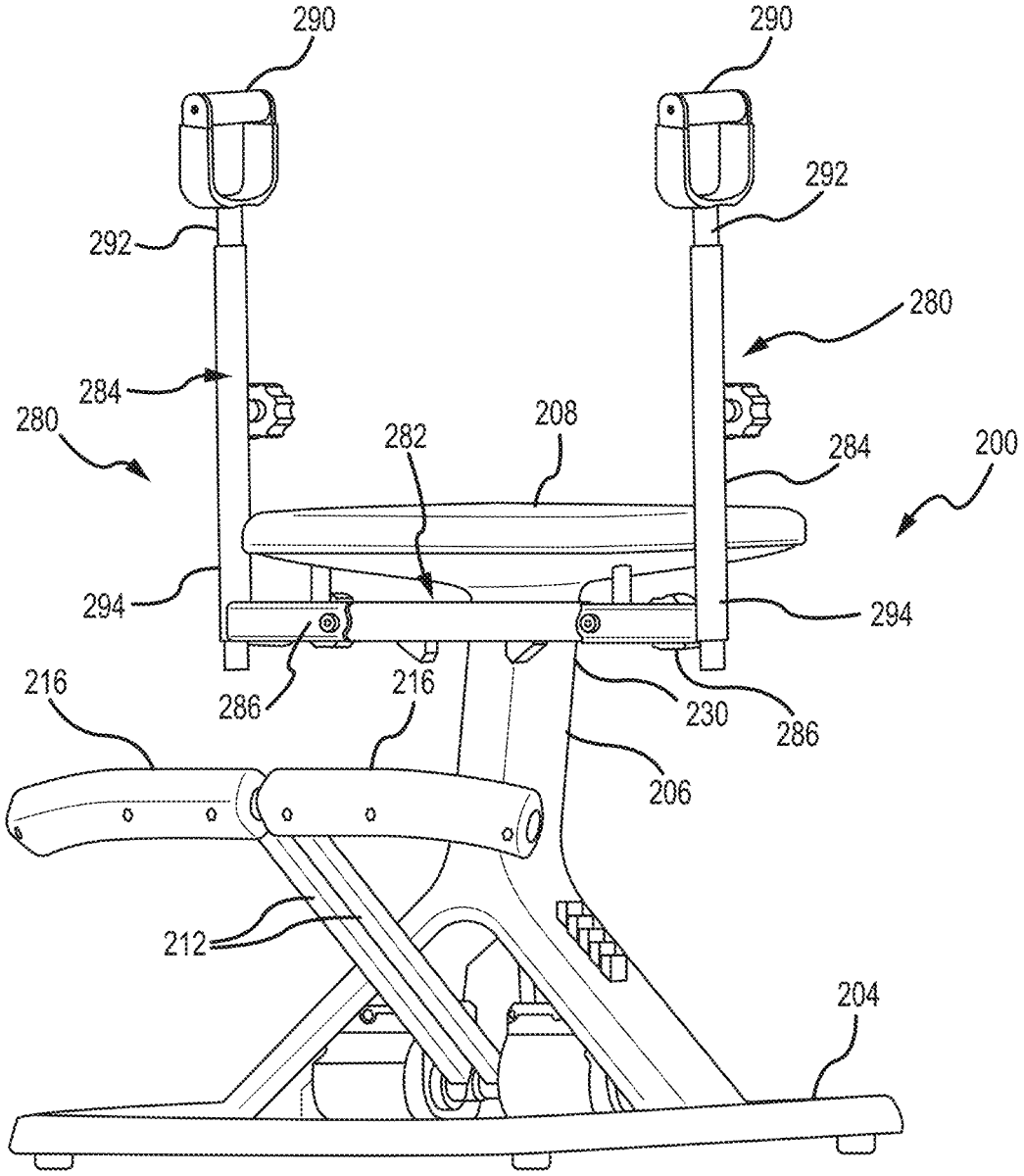
FIG. 15 is a front perspective view of an exemplary front view of an exemplary embodiment of a chair exercise apparatus having hinged hand support posts.
Figure 16:
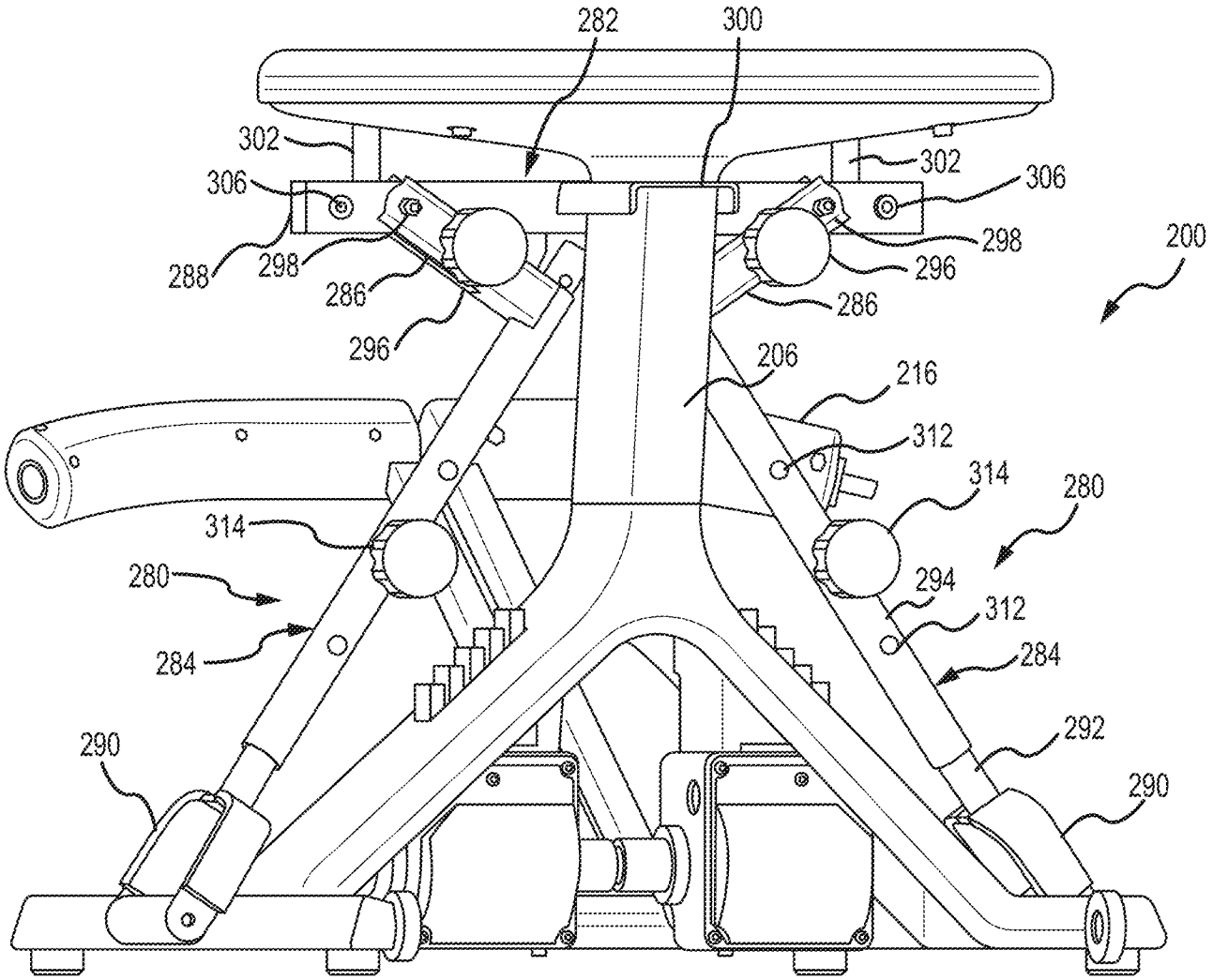
FIG. 16 is a rear perspective view of the chair exercise apparatus shown in FIG. 15.

Turning now to FIGS. 15 and 16, one exemplary embodiment of a chair exercise apparatus 200 having exemplary hinged hand support posts 280 is shown. In FIG. 15, the chair 200 is shown with the support posts 280 in an operable position each extended alongside the seat 208. In the rear perspective view of FIG. 16, the support posts 280 are shown in a storage position folded down beneath the seat 208.

Each support post member 280 for a chair exercise apparatus 200 in accordance with the present disclosure may be hinged and moveable from a retracted storage position as shown in FIG. 16 beneath the chair exercise apparatus seat 208 to an operable position alongside the seat 208 of the exercise apparatus 200 and preferably includes a mounting bracket 282 configured to be fastened to part a frame of the chair exercise apparatus 200. The support post member 280 preferably has a long leg 284 and a short leg 286. Preferably the short leg 286 extends at an angle from the long leg 284 and is hinged to a cross member 288 of the mounting bracket 282.

This mounting bracket 288 is fastened to either the frame 204 and/or the seat support 206 immediately beneath the seat 208. The support post member 280 preferably has a handle 290 fastened to a distal end of the hinged post member 280. The long leg 284 of the hinged support post member 280 preferably has a first portion 292 telescopically carried within a second portion 294 and the short leg 286 extends at a right angle from a proximal end of the long leg 284. The handle 290 is preferably removably fastened to a distal end of the first portion 292 of the long leg 284 of the hinged post member 280.

The short leg 286 of the hinged post member 280 preferably has a locking member 296 engageable with the cross member 288 of the mounting bracket 282 to releasably hold the short leg 286 parallel to the cross member 288 in an operating position when the hinged post member 280 is fastened to the chair exercise apparatus 200.

An exemplary embodiment of a chair exercise apparatus 200 in accordance with the present disclosure, shown in FIGS. 15 and 16 has a frame 204 configured to rest on a horizontal surface such as a floor. The chair exercise apparatus 200 includes an inverted Y shaped seat support 206 fastened to an upper surface portion of the frame 204, a seat 208 fastened to an upper end 230 of the inverted Y shaped seat support 206, a pair of parallel arms 212 each having a proximal end pivotally fastened to the frame 204 and a foot support or pedal 216 fastened to a distal end 214 of each of the parallel arms 212. Each arm 212 is biased away from the frame 204 toward the seat 208.

A pair of hinged support post members 280 are each preferably removably fastened to a mounting bracket 288 attached to the upper portion 230 of the inverted Y shaped seat support 206. Each hinged support post member 280 is movable from a storage position below the seat 208 as shown in FIG. 16 to an operable position extending upward alongside the seat 208 as is shown in FIG. 15. Each hinged support post member 280 has a long leg 284 and a short leg 286. The short leg 286 extends at a right angle from the long leg 284. The short leg 286 is hinged at hinge 298 to a cross member 296 of the mounting bracket 282.

In FIG. 16, the mounting bracket 282 is clearly shown which has square tube cross member 288 that is fixed to an angle bracket portion 300 which may be inserted and fastened between and fixed between the upper portion 230 of the inverted Y shaped seat support 206 and the seat 208. Optionally a pair of lateral support posts 302 may also be provided between the cross member 288 and the seat 208 to provide additional rigidity to the sides of the seat 208.

Each of the support post members 280 has a locking knob 296 on the short leg 286 spaced from the hinge 298 that engages a complementary fitting 306 on the cross member 288 to securely fasten the short leg 286 parallel to the cross member 288 when the support members 280 are in the operable position as shown in FIG. 15. This locking knob 296 may threadably engage a complementary threaded fitting 306 or engage a detent in the cross member 288 to fasten the short leg 286 in position. The long leg 284 preferably has a first portion 292 telescopically received in a tubular second portion 294.

These first and second portions 292 and 294 may be fitted with appropriate fittings 312 to set the length of the support post 280 as desired. A locking knob 314 is preferably provided on the long leg 284 to fix the desired length of the long leg 284 when the support post member 280 is raised to and locked in the operable position shown in FIG. 15.

Many changes may be made to the exercise apparatus of this disclosure. For example, the torque unit cage or housing 134 or 234 may be made of plastic, metal or composite structure and may be a cast or molded body. The selectors 158 or 258 may all be the same height or of different heights depending on where on the inverted Y seat support member 106 or 206 they are located. Further, the inverted Y seat support member 106 or 206 may be other than a Y shape. The lower portion, for example, may have a more or less angled shape or horizontal orientation and thus the selectors 158 and 258 could be differently structured than as specifically shown. What is shown are simply two exemplary embodiments. The seat 108 and 208 and the foot rests 116 and 216 may have different shapes than as currently depicted. These pairs of foot rests 116 and 216 may be ganged together to operate the arms 112 as a single arm rather than two as shown. Such an arrangement could be accomplished by a U shaped sleeve over the foot rests 116 or a rod threaded through the foot rests 116, for example.

The optional handle supports 102 fastened to the sides of the seat 108 or 208 may be telescopically extendable and collapsible, or may be hinged, an example of which is shown in FIGS. 15 and 16, so as to be readily retracted or placed out of the way for easy storage when not needed. Throughout the disclosure the term "fastened" is used when describing the joinder between the seat, the seat support member, and the frame. It is to be understood that other means of joinder between frame and support elements may be utilized such as merging via welding or forming as a unitary connection as in a single molded body, for example.

In the embodiments described, there are 7 sets of springs 146 within each cassette 138 and 238. Many other embodiments are envisioned each having different numbers of springs 146. The flat coil springs 146 may be interrelated or connected such that depression of one selector 158 or 258 may retract other selectors so as to limit the number of springs that can be engaged at any one time. Furthermore, the rotary arm torque unit 210 may be configured to be utilized in place of conventional springs in a conventional Pilates chair exercise apparatus. In such an alternative implementation, the selectors 258 and the cassette cage or housing 234 would preferably be shaped differently in accordance with the frame configuration of such a conventional Pilates chair exercise apparatus.

Figure 17:
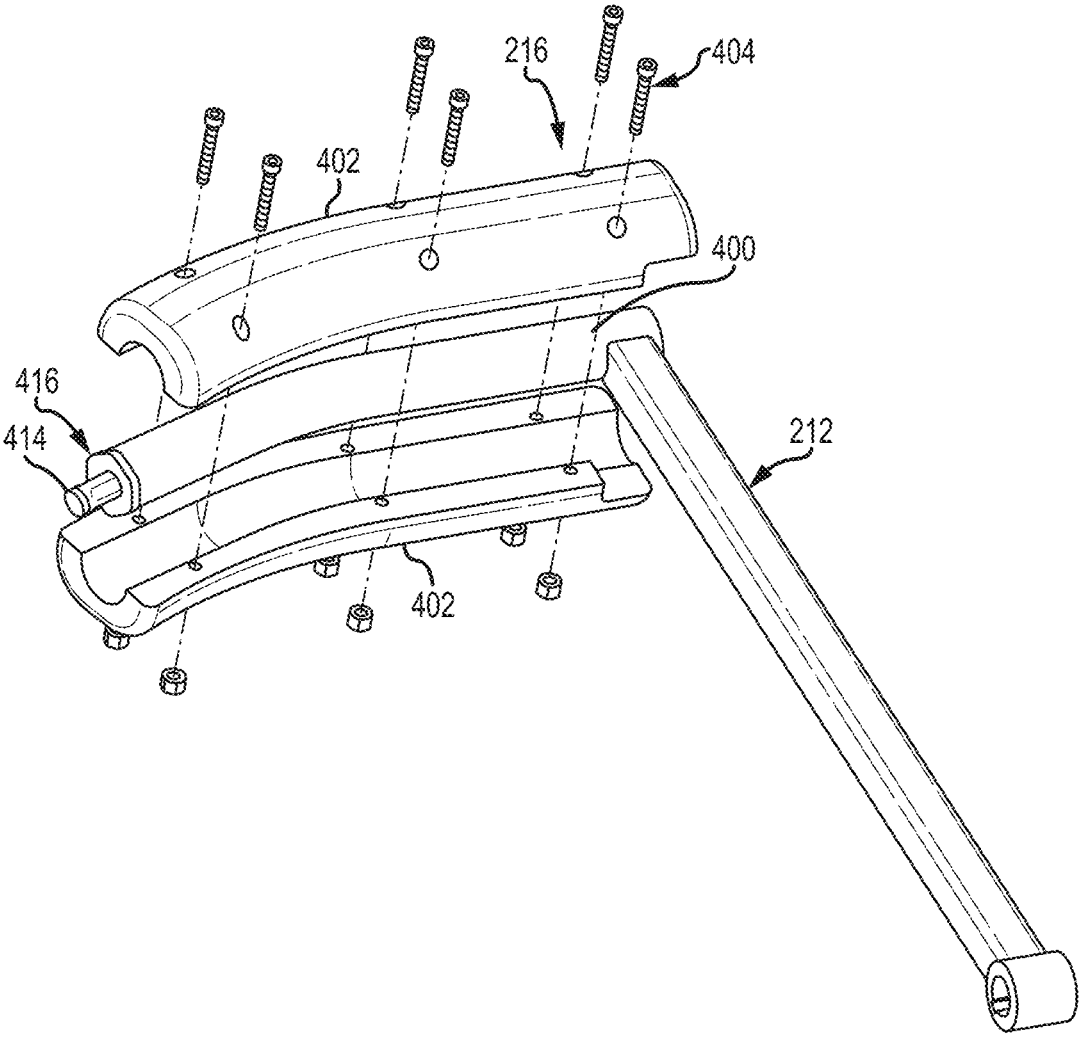
FIG. 17 is separate partially exploded view of a foot support arm and pedal removed from the embodiment shown in FIGS. 10, 15 and 16
Figure 18:
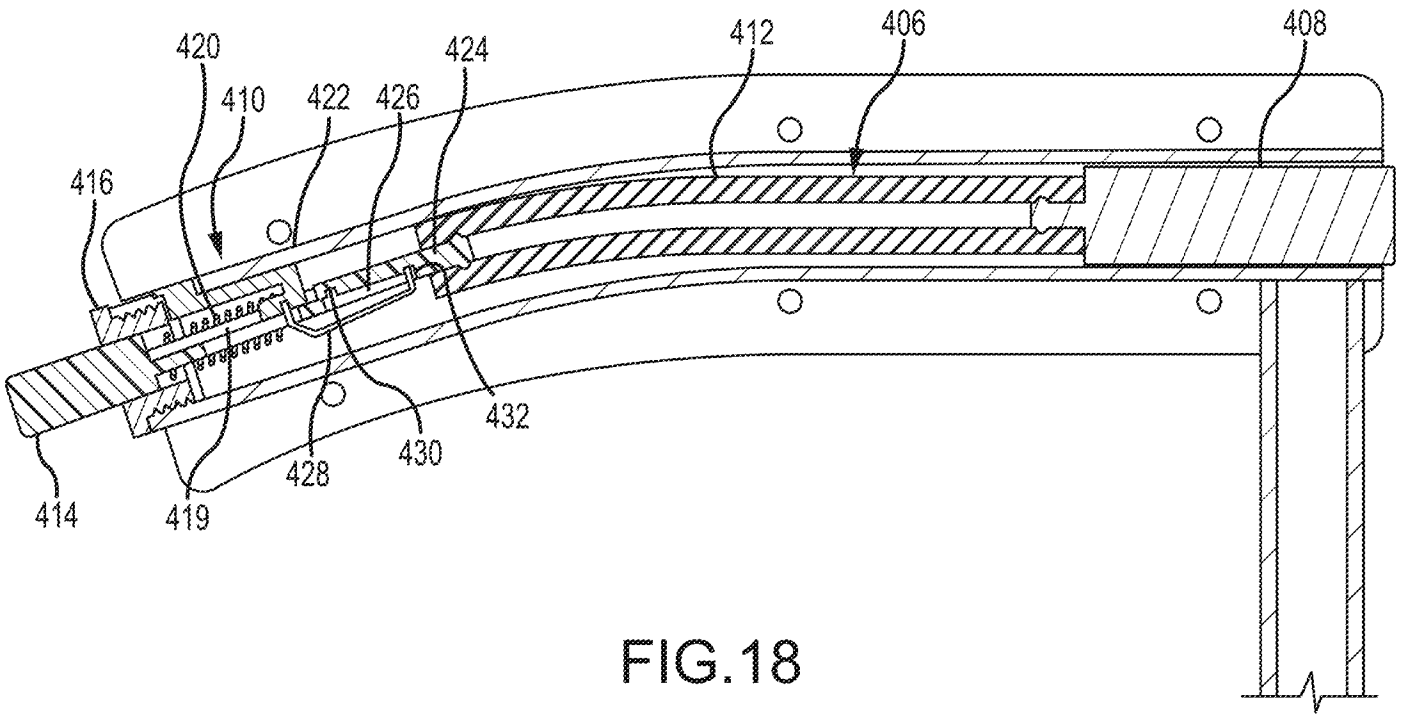
FIG. 18 is a partial sectional view of the foot support pedal shown in FIG. 17.

A separate perspective view of one of the arm members 212 with its foot rest/pedal 216 is shown in FIG. 17. A cross-sectional view through the arm member 216 shown in FIG. 17 is shown in FIG. 18. Referring now to FIG. 17, the foot rest pedal/support 216 includes a hollow metal tube 400 sandwiched between two cushion halves 402. These cushion halves 402 are fastened to the tube 400 with a set of threaded fasteners 404. The cushion halves 402 may be fabricated from either a hard plastic material or a flexible closed cell foam to provide some cushioning to the foot rest pedal/support 216.

One end of the tube 400 is welded to the distal end of the arm member 212. The tube 400 carries a retractable member 406 therein configured to engage a portion of a corresponding opposite foot support 216 to selectively lock the foot support and the corresponding opposite foot support 216 together. This retractable member 406 includes a cylindrical pin member 408 and a push button actuator assembly 410 that connects to the cylindrical pin member 408 via a flexible link or tube 412. The cylindrical pin member 408 is shown retracted in FIG. 19, allowing each foot pedal 216 to be separately operated, and extended into the corresponding tube 400 of the opposite foot support 216 in FIG. 20, fastening the two foot pedals 216 together.

The push button actuator assembly 410 includes a push button 414 that slides within a threaded collar or retaining nut 416 that is threaded into the distal end of the tube 400. This push button 414 has a stem portion 418 that carries a compression spring 420 connected between a mounting base support 422 in the tube 400 and the push button 414 so as to resiliently bias the push button 414 out of the end of the tube 400. The stem portion 418 has an elongated slot 419 that engages part of the mounting base support 422 to permit the push button 414 to move in and out of the tube 400 within and through the retaining nut 416. The stem portion 418 of the push button 414 is free to slide along the slot 419 engaging the mounting base support 422. The stem portion 418 also has a connecting portion 424 extending therefrom that includes a closed loop slot 426 that guides location of a guide wire 428 between a first position 430 and a second position 432 along the stem portion 418.

This guide wire 428 has one end fixed to the mounting base support 422 and a distal end that rides within the closed loop slot 426. The distal end of the connecting portion 424 is fastened to one end of the flexible link or tube 412. The other end of the flexible link or tube 412 is fastened to the cylindrical pin member 408. During operation of the push button actuator assembly 410, the retaining nut 416, the mounting base support 422 and the guide wire 428 remain stationary within the tube 400. The push button 414, its stem portion 418 and connecting portion 424 move together within the tube 400 to in turn move the flexible link 412 and the cylindrical pin member 408 such that a portion of the cylindrical pin member 408 can extend into and out of the adjacent tube 400 of the adjacent foot support pedal 216.

Figure 19:
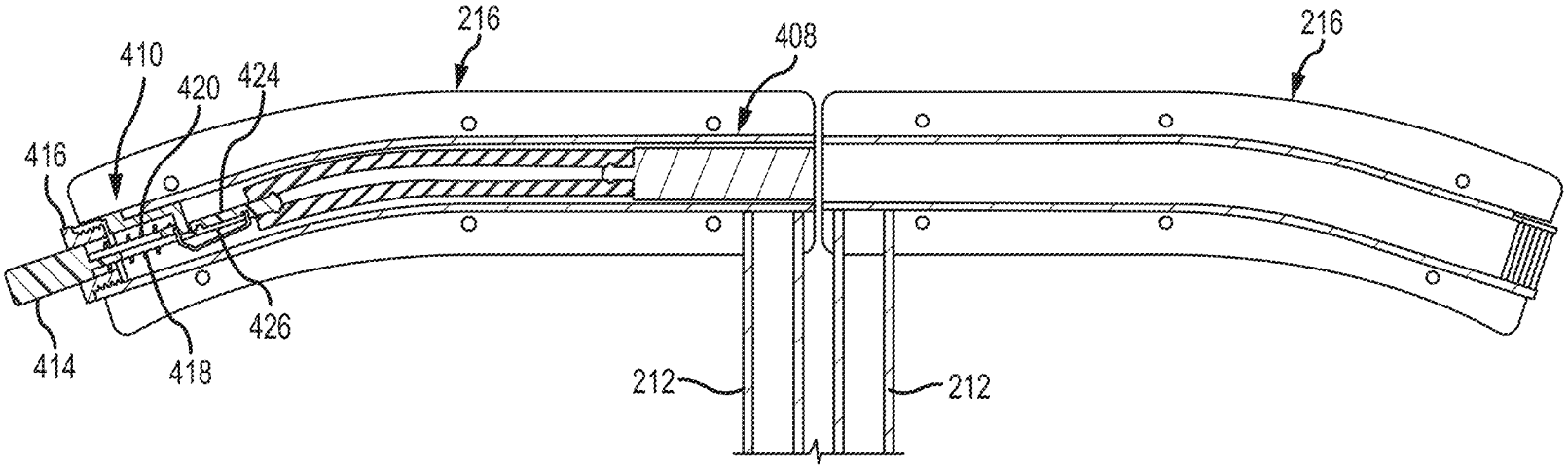
FIG. 19 is a partial sectional view of a pair of foot support pedals shown in FIG. 16 with the retractable member retracted.
Figure 20:
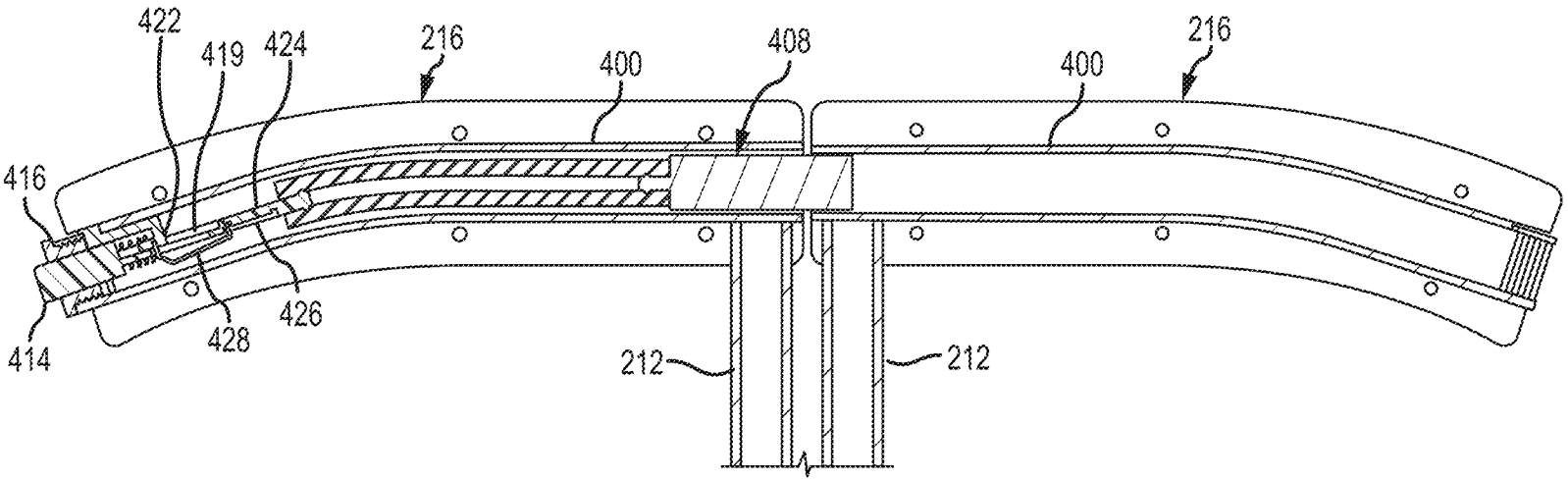
FIG. 20 is a partial sectional view of the pair of foot support pedals shown in FIG. 16 with the retractable member extended to lock the foot support pedals together.

Operation of the retractable member 406 via push button actuator assembly 410 is shown in FIGS. 19 and 20. In FIG. 19, push button 414 is shown extended out of the retention collar or retaining nut 416 which causes compression spring 420 to push the flexible link 412 and cylindrical pin member 408 out of engagement with the adjacent foot support member 216, thus enabling separate operation of each foot support rest or pedal 216. In this FIG. 19, the guide wire 428 is at the distal end of slot 426 at position 432.

In FIG. 20, the retractable member 406 is shown with the cylindrical pin member 408 engaged in the proximal end of the tube 400 of the adjacent foot support rest 216. This locks the foot support rests 216 together. In FIG. 20, the push button 414 is pushed in such that the stem 424 has extended to a position such that the guide wire 428 is at position 430 in the loop slot 426. The guide wire 428 engages a depression in the loop slot 426 at location 430 to hold the stem portion 418 of the push button 414 in place until the push button 414 is again pushed in to release the guide wire out of location 430 430 which permits the stem portion 424 and push button 414 to move to the retracted position shown in FIG. 19.

Accordingly, all such alternatives, variations and modifications are intended to be encompassed within the scope of and as defined by the following claims.

What is claimed is:

1. A chair exercise apparatus comprising:

a frame configured to rest on a horizontal surface;

an inverted Y shaped seat support fastened to an upper surface portion of the frame, the inverted Y shaped seat support having two lower ends merging upward into a common upper end, the two lower ends being fastened to the upper surface portion of the frame;

a seat fastened to the common upper end of the inverted Y shaped seat support; and a pair of parallel arms each having a proximal end fastened to the frame and a foot support fastened to a distal end of each of the parallel arms, wherein each arm is biased away from the frame toward the seat, wherein one foot support carries a retractable member therein configured to selectively extend out of the one foot support so as to engage a portion of a corresponding opposite foot support to lock the one foot support and the corresponding opposite foot support together, wherein each foot support includes a hollow tube having one end fastened to one of the parallel arms and the retractable member is carried in the one end of the hollow tube in the one foot support so as to be extendable into the hollow tube of the corresponding opposite foot support and a push button actuator fastened in the hollow tube connected to the retractable member.

2. The chair exercise apparatus according to claim 1 further comprising a flexible member carried in the hollow tube connecting the push button actuator to the retractable member.

3. The chair exercise apparatus according to claim 1 wherein the retractable member is a cylindrical pin sized to extend partially from within the one foot support into a portion of the hollow tube of the corresponding opposite foot support.

4. A chair exercise apparatus comprising:

a frame configured to rest on a horizontal surface;

an inverted Y shaped seat support fastened to an upper surface portion of the frame, the inverted Y shaped seat support having two lower ends merging upward into a common upper end, the two lower ends being fastened to the upper surface portion of the frame;

a seat fastened to the common upper end of the inverted Y shaped seat support; and a pair of parallel arms each having a proximal end fastened to the frame and a foot support fastened to a distal end of each of the parallel arms, wherein each arm is biased away from the frame toward the seat, wherein one foot support carries a retractable member therein configured to selectively extend out of the one foot support so as to engage a portion of a corresponding opposite foot support to lock the one foot support and the corresponding opposite foot support together wherein the retractable member is actuated by a push button actuator extending out of an opposite end of the one foot support.

5. The chair exercise apparatus according to claim 4 wherein the retractable member is coupled to the push button actuator by a flexible member.

6. The chair exercise apparatus according to claim 5 wherein the flexible member is a polymer tube.

7. The chair exercise apparatus according to claim 4 wherein each foot support includes a hollow tube having one end fastened to one of the parallel arms and the retractable member is carried in the one end of the hollow tube in the one foot support so as to be extendable into the hollow tube of the corresponding opposite foot support.

8. A chair exercise apparatus comprising:

a frame configured to rest on a horizontal surface;

an inverted Y shaped seat support fastened to the frame, the seat support having two lower ends merging upward into a common upper end;

a seat fastened to the common upper end of the inverted Y shaped seat support;

a pair of parallel arms each having a proximal end fastened to the frame and a foot support fastened to a distal end of each of the parallel arms, wherein each arm is biased away from the frame toward the seat, wherein one foot support carries a retractable member therein configured to engage a portion of a corresponding opposite foot support to selectively lock the one foot support and the corresponding opposite foot support together; and a push button actuator assembly carried within the one foot support, wherein the push button actuator assembly includes a push button that extends out of an opposite end of the one foot support.

9. The chair exercise apparatus according to claim 8 further comprising a flexible member connected between the push button and the retractable member, and wherein the push button is biased between a first position in which the retractable member is withdrawn within the one foot support and a second position in which the retractable member extends out of the one foot support so as to engage the portion of the corresponding opposite foot support to lock the one foot support and the corresponding opposite foot support together.

* * * * *